US010480802B2

(12) United States Patent
Terlson et al.

(10) Patent No.: US 10,480,802 B2
(45) Date of Patent: Nov. 19, 2019

(54) HUMIDIFIER WITH WATER VALVE CONTROL

(71) Applicant: Ademco Inc., Golden Valley, MN (US)

(72) Inventors: Brad Terlson, Maple Grove, MN (US); David Quam, St. Louis Park, MN (US); Christopher Goh, Chanhassen, MN (US)

(73) Assignee: Ademco Inc., Golden Valley, MN (US)

( * ) Notice: Subject to any disclaimer, the term of this patent is extended or adjusted under 35 U.S.C. 154(b) by 431 days.

(21) Appl. No.: 15/194,688

(22) Filed: Jun. 28, 2016

(65) Prior Publication Data

US 2016/0305675 A1 Oct. 20, 2016

Related U.S. Application Data

(63) Continuation of application No. 12/565,716, filed on Sep. 23, 2009, now Pat. No. 9,404,666.

(51) Int. Cl.

| | |
|---|---|
| ***F24F 6/04*** | (2006.01) |
| ***F24F 11/00*** | (2018.01) |
| ***F24F 11/30*** | (2018.01) |
| *F24F 110/20* | (2018.01) |

(52) U.S. Cl.

CPC ..... *F24F 6/04* (2013.01); *F24F 6/043* (2013.01); *F24F 11/0008* (2013.01); *F24F 11/30* (2018.01); *F24F 2110/20* (2018.01); *Y10S 261/15* (2013.01)

(58) Field of Classification Search

CPC ..... F24F 6/00; F24F 6/02; F24F 6/043; F24F 11/0008; Y10S 261/15; Y10S 261/34

See application file for complete search history.

(56) References Cited

U.S. PATENT DOCUMENTS

| | | | |
|---|---|---|---|
| 2,101,603 | A | 12/1937 | Stimson |
| 3,491,745 | A | 1/1970 | Caignet |
| 3,570,822 | A | 3/1971 | Peterson |
| 3,672,706 | A | 6/1972 | Chilcoat |
| 3,965,691 | A | 6/1976 | Van Huis |
| 3,975,470 | A | 8/1976 | Engel |

(Continued)

FOREIGN PATENT DOCUMENTS

| | | |
|---|---|---|
| CA | 2312402 A1 | 1/2001 |
| JP | 54023240 | 2/1979 |

(Continued)

OTHER PUBLICATIONS

Aprilaire Humidifiers, "Owner's Manual for Models 350, 360,400, 400M, 500, 500M, 600, 600M, 700 & 700M," 11 pages, 2010.

(Continued)

*Primary Examiner* — Jonathan Bradford

(74) *Attorney, Agent, or Firm* — Shumaker & Sieffert, P.A.

(57) ABSTRACT

A call for humidity signal may activate a water valve of a humidifier to cause water to flow onto a humidifier pad within the humidifier. In some examples, a controller may activate the water valve in a pattern such that most of the water evaporates, rather than flowing to a drain system, yet still provides the requested humidity level. In some examples, the controller is configured to cause the water valve to deliver water to the humidifier pad in a water delivery pattern having a controlled period and a controlled duty cycle.

20 Claims, 18 Drawing Sheets

(56) References Cited

U.S. PATENT DOCUMENTS

| | | | |
|---|---|---|---|
| 4,158,679 | A | 6/1979 | Yeagle |
| D253,846 | S | 1/1980 | Morrow |
| D258,609 | S | 3/1981 | Vogt |
| 4,312,189 | A | 1/1982 | Cotton, Jr. |
| 4,347,712 | A | 9/1982 | Benton et al. |
| D280,660 | S | 9/1985 | Muchenberger |
| D281,271 | S | 11/1985 | Meyer et al. |
| 4,559,789 | A | 12/1985 | Riek |
| 4,564,746 | A | 1/1986 | Morton et al. |
| D283,265 | S | 4/1986 | Preskey et al. |
| 4,589,409 | A | 5/1986 | Chatburn et al. |
| 4,994,211 | A | 2/1991 | Fuller |
| 5,000,381 | A | 3/1991 | Mueller et al. |
| D320,072 | S | 9/1991 | Youngeberg |
| D322,122 | S | 12/1991 | Guetersloth et al. |
| 5,075,047 | A | 12/1991 | Youngeberg |
| 5,129,547 | A | 7/1992 | Fisher et al. |
| D338,952 | S | 8/1993 | Snow |
| 5,252,260 | A | 10/1993 | Schuman |
| D342,989 | S | 1/1994 | Wallen |
| 5,461,875 | A | 10/1995 | Lee et al. |
| D370,254 | S | 5/1996 | Danes et al. |
| 5,598,971 | A | 2/1997 | Winther et al. |
| 5,755,283 | A | 5/1998 | Yates et al. |
| 5,851,444 | A | 12/1998 | Hansell, Jr. et al. |
| D409,737 | S | 5/1999 | Nilsson |
| D416,994 | S | 11/1999 | Kensok et al. |
| 6,354,572 | B1 | 3/2002 | Menassa |
| D456,887 | S | 5/2002 | Zlotnik |
| D458,356 | S | 6/2002 | Redner et al. |
| 6,575,436 | B2 | 6/2003 | Litz |
| 6,588,734 | B2 | 7/2003 | Redner et al. |
| D486,896 | S | 2/2004 | Long et al. |
| D492,759 | S | 7/2004 | Yoshida |
| 6,845,755 | B2 | 1/2005 | Cook et al. |
| D516,192 | S | 2/2006 | Kang |
| D516,689 | S | 3/2006 | Salmon et al. |
| D519,622 | S | 4/2006 | Cocchi |
| D532,497 | S | 11/2006 | Engel et al. |
| D538,416 | S | 3/2007 | Ediger et al. |
| D540,819 | S | 4/2007 | Schmitt et al. |
| D540,929 | S | 4/2007 | Kowis et al. |
| 7,234,516 | B2 | 6/2007 | Umebayashi et al. |
| D554,246 | S | 10/2007 | Seelig et al. |
| D557,784 | S | 12/2007 | Stead |
| D573,703 | S | 7/2008 | Gosselin et al. |
| 7,434,741 | B2 | 10/2008 | Helt et al. |
| D593,190 | S | 5/2009 | Glass |
| D596,728 | S | 7/2009 | Campbell et al. |
| D598,526 | S | 8/2009 | Pitchford et al. |
| D600,252 | S | 9/2009 | Yan et al. |
| D630,310 | S | 1/2011 | Beland et al. |
| D631,145 | S | 1/2011 | Beland et al. |
| 8,231,112 | B2 | 7/2012 | Cao et al. |
| 8,292,270 | B2 | 10/2012 | Terlson et al. |
| 8,302,943 | B2 | 11/2012 | Wang et al. |
| 8,794,603 | B2 | 8/2014 | Quam et al. |
| 8,833,739 | B2 | 9/2014 | Wang et al. |
| 9,404,666 | B2 | 8/2016 | Terlson et al. |
| 2005/0252983 | A1 | 11/2005 | Acker, Jr. |
| 2006/0073794 | A1* | 4/2006 | Stortoni ..... G06K 19/0716 455/88 |
| 2006/0086814 | A1 | 4/2006 | Helt et al. |
| 2006/0214315 | A1* | 9/2006 | Williams ..... F24F 6/043 261/26 |
| 2007/0063059 | A1 | 3/2007 | Votaw et al. |
| 2008/0079177 | A1 | 4/2008 | Schuld |
| 2011/0067851 | A1 | 3/2011 | Terlson et al. |
| 2011/0068486 | A1 | 3/2011 | Quam et al. |
| 2011/0068488 | A1 | 3/2011 | Cao et al. |
| 2011/0068489 | A1 | 3/2011 | Terlson et al. |
| 2011/0068490 | A1 | 3/2011 | Wang et al. |
| 2011/0068491 | A1 | 3/2011 | Wang et al. |

FOREIGN PATENT DOCUMENTS

| | | |
|---|---|---|
| JP | 1003442 | 1/1989 |
| JP | 04003845 | 1/1992 |
| JP | 2004293936 | 10/2004 |

OTHER PUBLICATIONS

Aprilaire Humidifiers, "Owner's Manual for Models 110, 112, 220, 224, 350, 360, 440,445, 448, 558, 560, 568, 760 & 768," 20 pages, 2005.

Carrier, "Humidifiers Homeowner's Manual," 8 pages, 1998.

An Office Action in Ex Parte Reexamination of U.S. Pat. No. 8,794,603, Control No. 90/013,620, dated Apr. 25, 2016.

General Aire, "Water Savor Controller, Installation Instructions," 4 pages, Mar. 2015.

Honeywell "HE360 Powered Flow-Through Humidifier, Owner's Guide" 8 pages, 1997.

Honeywell, "HE225 Bypass Flow-Through Humidifier," 8 pages 2010.

http://www.desertspringproducts.com/desertspring/humidifiers_pulsed.asp, "Desert Spring Products—Pulsed Flow-Through Humidifier," 3 pages, printed Nov. 16, 2015.

https://www.amresupply.com/part/10547143, "Desert Spring Humidifier Pulse Flow Controller," 1 page, printed Apr. 11, 2016.

Order Granting Request for Ex Parte Reexamination of U.S. Pat. No. 8,794,603, Control No. 90/013,620, dated Dec. 31, 2015.

Request for Ex Parte Reexamination of U.S. Pat. No. 8,794,603, dated Nov. 4, 2015.

Thermolec, "Pro 600 Humidifier, Installation Instructions," Revised Version, 3 pages, Jul. 2005.

Thermolec, "Pro-600 Owner's Instructions for Electronically Controlled Flow Thru Humidifier Operating and Maintenance Tips—Warranty," 2 pages, Nov. 18, 2002.

Office Action in Canadian Application No. 2,714,325, dated Mar. 16, 2017.

Notice of Allowance from counterpart Canadian Application No. 2,996,347, dated Jan. 28, 2019, 1 pp.

Prosecution History from U.S. Appl. No. 12/565,719, dated Apr. 4, 2012 through Mar. 31, 2014, 41 pp.

Prosecution History from U.S. Appl. No. 90/013,620, dated Nov. 4, 2015 through Feb. 21, 2017, 207 pp.

Prosecution History from U.S. Appl. No. 12/565,716, dated Feb. 14, 2013 through Apr. 4, 2016, 295 pp.

Notice of Allowance, and translation thereof, dated Sep. 2, 2010, from counterpart Canadian application No. 2,714,325, 1 pp.

First Office Action from counterpart Canadian Patent Application No. 2,996,347, dated Apr. 11, 2018, 9 pp.

Response to Canadian Office Action dated Apr. 11, 2018, from counterpart Canadian application No. 2,996,347, filed Oct. 1, 2018, 11 pp.

Honeywell, "TrueEASE Humidification System, Professional Installation Guide," 69-2413EF-17, accessed online revised May 2016, 72 pp.

* cited by examiner

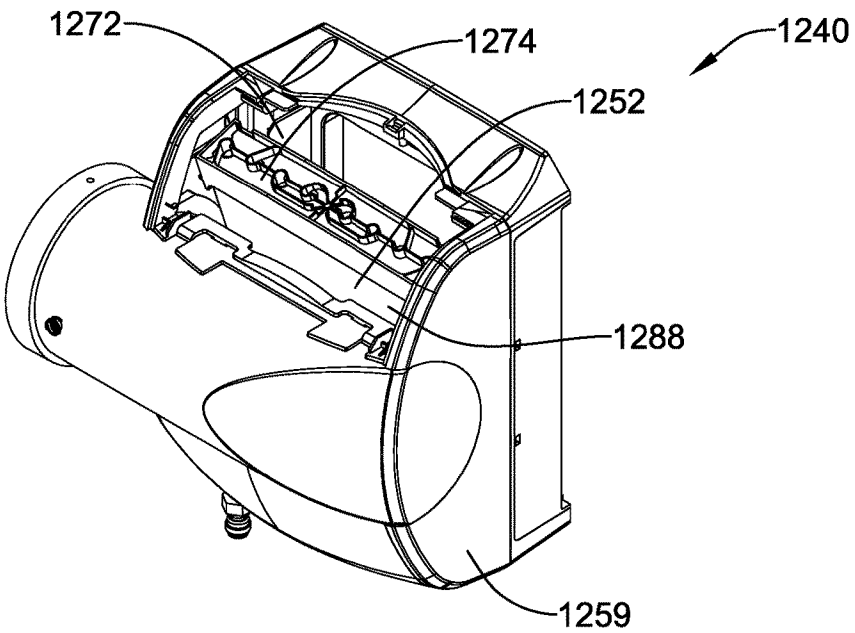
Figure 13
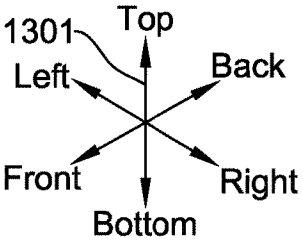

HUMIDIFIER WITH WATER VALVE CONTROL

This is a continuation of co-pending U.S. patent application Ser. No. 12/565,716, filed Sep. 23, 2009, and entitled "BYPASS HUMIDIFIER WITH DAMPER CONTROL", which is incorporated herein by reference.

TECHNICAL FIELD

The disclosure relates generally to humidifiers for adding humidity to an inside space of a building structure, and more particularly, to such bypass humidifiers that are configured to be mounted to a duct, plenum or the like of an HVAC system during operation.

BACKGROUND

In dry or cold climates, it is often necessary to add moisture to the air inside enclosed spaces in order to maintain desired humidity levels. There are many products on the market employing a variety of techniques to increase humidity levels. Some example techniques include steam injection, water atomization, and evaporation. Evaporative humidifiers are widely used in conjunction with forced air residential and commercial heating, ventilation, and air conditioning (HVAC) systems.

Some evaporative humidifiers direct air from an air stream of an HVAC system, through a moistened humidifier pad, and back into an air stream of the HVAC system. Such humidifiers often include a housing mounted to an air duct, plenum or the like of the HVAC system. The housing typically includes an internal cavity that houses the humidifier pad, an air inlet that directs an incoming air stream from the HVAC system to the humidifier pad, and an air outlet that directs a moistened air stream from the humidifier pad and into an air stream of the HVAC system. In some humidifiers, a powered fan is provided to help force air from the air inlet to the air outlet and through the humidifier pad. In other humidifiers, a pressure differential created by the main circulating fan or blower of the HVAC system between the return air duct and the supply air duct is used to draw air from the supply air duct, through the humidifier pad of the humidifier, and to the return duct of the HVAC system.

In some cases, a controller is used to activate the humidifier. In many cases, the controller includes or is coupled to a humidity sensor that is located within the control space of the building. When the sensed humidity is below a humidity set point, the controller may provide a call for humidity signal to the humidifier. In many systems, such a call for humidity signal activates a solenoid water valve or the like of the humidifier, which when activated, allows water to flow from a water source onto the humidifier pad within the humidifier housing. When the call for humidity ends, such as when the sensed humidity rises above the humidity set point, the controller may deactivate the solenoid water valve, which prevents further water from flowing onto the humidifier pad. In many cases, a distributor tray is positioned along the top of the humidifier pad to distribute the water from the solenoid water valve relatively uniformly along the top surface of the humidifier pad. Water that passes down through and to the bottom of the humidifier pad can be collected by a collection tray and routed and expelled to a drain of the building.

SUMMARY

In an illustrative but non-limiting example, the disclosure provides a humidifier system for adding humidity to an air stream of an HVAC system. The humidifier system includes an air path that is configured to accept air from a first HVAC duct and return air to a second HVAC duct. A damper may be disposed in the air path that is configured to selectively substantially block the flow of air in the air path or to substantially not block the flow of air in the air path. In some cases, the damper may be a motorized damper, and the humidifier system may include a controller that is configured to cause the motorized damper to not substantially block the flow of air in the air path during a call for humidifier operation, and to substantially block the flow of air in the air path after the call for humidifier operation ends.

This disclosure also describes an illustrative HVAC controller, such as a thermostat, for use in controlling an HVAC system that includes a humidifier system with a manually operated bypass damper. The manually operated bypass damper may be situated in the bypass air path of a bypass humidifier. The illustrative thermostat may include a user interface having a display and a controller coupled to the display. The controller may provide one or more control signals for controlling at least part of the HVAC system, and may determine when it is desirable to manually change the position of the manually operated bypass damper of the bypass humidifier. When the latter determination is made, the illustrative thermostat may display a message on the display that indicates that the position of the manually operated bypass damper of the bypass humidifier should be changed. Alternatively, or in addition, the illustrative thermostat may notify a user that the position of the manually operated bypass damper should be changed by, for example, displaying an icon, flashing certain parts of the display, issuing an audio signal such as a beep, etc. In some cases, the thermostat may cause an email or text message to be sent to a user.

The above summary is not intended to describe each and every disclosed illustrative example or every implementation of the disclosure. The Description that follows more particularly exemplifies the various illustrative embodiments.

BRIEF DESCRIPTION OF THE FIGURES

The following description should be read with reference to the drawings. The drawings, which are not necessarily to scale, depict selected illustrative embodiments and are not intended to limit the scope of the disclosure. The disclosure may be more completely understood in consideration of the following detailed description of various illustrative embodiments in connection with the accompanying drawings, in which:

FIG. 13 is a schematic view of the illustrative bypass humidifier of FIG. 10 with the front cover removed and the humidifier pad and water distributor pivoted forward in an intermediate stage of pad maintenance;

DESCRIPTION

The following description should be read with reference to the drawings, in which like elements in different drawings are numbered in like fashion. The drawings, which are not necessarily to scale, depict selected illustrative embodiments and are not intended to limit the scope of the invention. Although examples of construction, dimensions, and materials are illustrated for the various elements, those skilled in the art will recognize that many of the examples provided have suitable alternatives that may be utilized.

Figure 1:
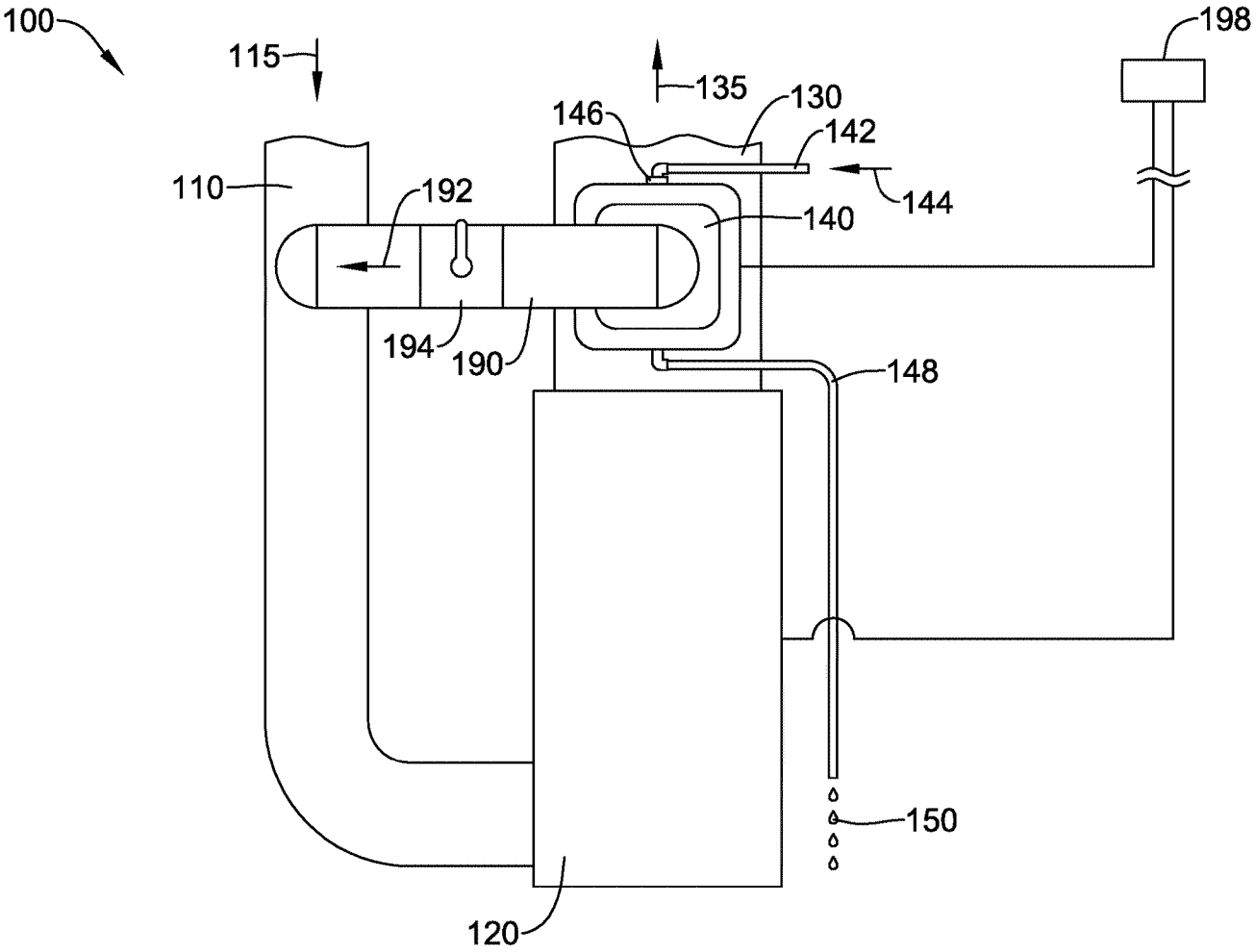
FIG. 1 is a schematic diagram showing a portion of a forced air HVAC system and an illustrative bypass humidifier.

FIG. 1 is a schematic diagram showing a portion of a forced air HVAC system 100 and an illustrative bypass humidifier. The illustrative forced air HVAC system 100 is an up-flow type, but it is contemplated that any suitable forced air HVAC system 100 may be used (e.g., down-flow, horizontal-flow, etc.). In the illustrative HVAC system 100, return air duct 110 delivers return air 115 from a conditioned air space to cabinet 120. Cabinet 120 encloses an air handler, or air-handling fan (not shown), that when activated pulls air from the enclosed space via the return air duct 110, and delivers conditioned air 135 to the enclosed spaced via a supply air duct 130.

The illustrative cabinet 120 may include components to help condition the return air 115 before supplying it to the conditioned air space via the supply air duct 130. For example, it is contemplated that cabinet 120 may include one or more filters (not shown) for removing particulates and/or other contaminants from the return air 115. In another example, the cabinet 120 may enclose a heat exchanger (not shown), such as a gas burner, an electric resistance heating element, an evaporator and/or condenser coil, and/or any other type of heat exchanger, as desired.

In FIG. 1, the HVAC system 100 is shown with an illustrative bypass type humidifier 140. The humidifier 140 includes a housing that is attached to the supply duct 130. A hole (not shown) is cut through the supply duct 130, and the humidifier 140 is mounted over the hole. A bypass duct 190 is coupled between the housing and the return air duct 110. In this configuration, and when the air-handling fan (not shown) of the HVAC system 110 is on, bypass air 192 is conveyed by bypass duct 190 from supply duct 130 to return duct 110, driven at least in part by a pressure difference between the ducts generated by the air-handling fan. In some cases, a bypass damper 194 may be disposed in the bypass duct 190, and may be adjusted to selectively block or unblock (i.e., not allow or allow) the flow of bypass air 192 in the bypass duct 190. In some cases, it is contemplated that the bypass humidifier 140 housing may be attached to the return duct 110, and the bypass air duct 192 may be connected between the humidifier 140 housing and the supply duct 130, with flow of bypass air 192 being driven from the supply air duct 130 to the return duct 110 by the pressure difference therebetween.

In any event, the bypass humidifier 140 of FIG. 1 is shown coupled to a water source 142 that supplies water 144 to the humidifier 140. A water source control valve 146 (e.g. a solenoid water valve) may be provided to control the flow of water 144 from the water source 142 to the humidifier 140. When flowing, water 144 is provided to a humidifier pad (not illustrated in this figure) within the humidifier 140, which moistens the humidifier pad. The humidifier 140 is configured such that bypass air 192 that passes from the supply air duct 130 to the return duct 110 via the bypass duct 190 must pass through the moistened humidifier pad. Evaporation of at least some of the water from the moistened humidifier pad may impart humidity to the bypass air 192. Some of the water provided to the humidifier pad may reach the bottom of the humidifier pad. This water 150 may be collected by a collection tray and routed and expelled to a drain of the building by a water drain pipe 148.

It is contemplated that the HVAC system 100 may includes an HVAC controller 198. The HVAC controller 198 may be configured to control one or more components of the HVAC system 100. In some cases, the HVAC controller 198 may include sub-controllers, which may be located together or separately, but this is not required in all embodiments. If present, sub-controllers may be communicatively coupled by any suitable mechanism, e.g., via wires, optical links, wireless RF, etc., to components of HVAC system 100 and/or to each other. In some cases, HVAC controller 198 may be or include a thermostat, a humidistat, temperature sensor(s), humidity sensor(s), and/or any other suitable sensor, processor, hardware, firmware, software, and/or any other components related to the monitoring and/or control of HVAC system 100 and/or humidifier 140.

Figure 2:
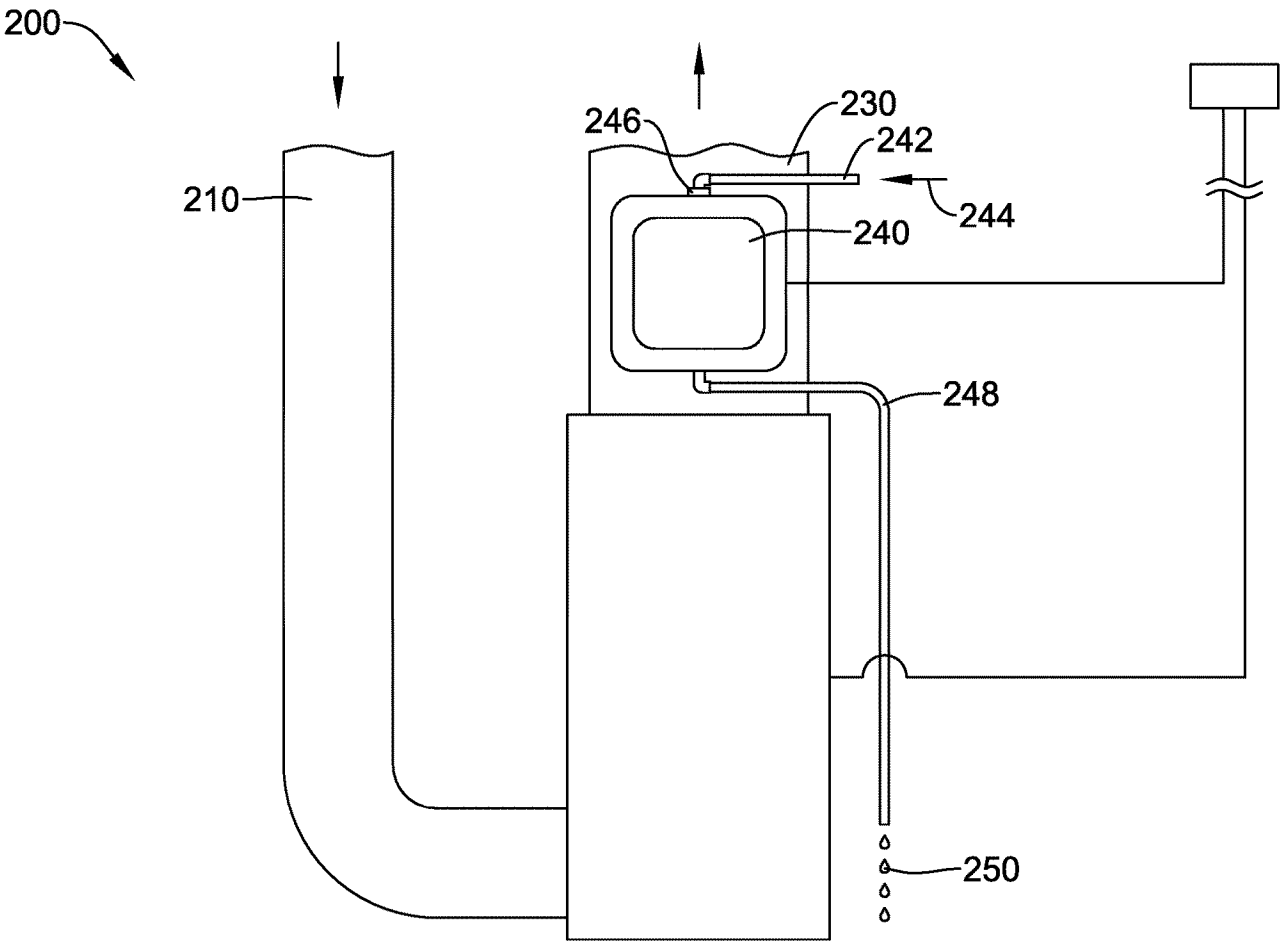
FIG. 2 is a schematic diagram showing a portion of a forced air HVAC system and an illustrative fan-assisted humidifier.

FIG. 2 is a schematic diagram showing a portion of a forced air HVAC system 200 and an illustrative fan-assisted humidifier 240. The illustrative HVAC system 200 shares several features with HVAC system 100 of FIG. 1. HVAC system 200 differs from HVAC system 100 by including a fan-assisted humidifier 240, rather than a bypass humidifier.

The illustrative fan-assisted humidifier 240 is shown attached to supply air duct 230, although in some illustrative embodiments, it may be attached to return duct 210 or any other suitable location where it may be fluidically connected with HVAC air. As shown, fan-assisted humidifier 240 is configured to draw air from supply air duct 230 through an air intake (not shown) under the influence of a humidifier fan (not shown), pass the air through a moistened humidifier pad (not shown), during which moisture may be imparted to the air via evaporation, and return the air to the same duct through an air outlet port (not shown). Similarly to humidifier 140 of FIG. 1, humidifier 240 of FIG. 2 may be coupled to a water source 242 that supplies water 244 to the humidifier pad of the humidifier 240 through a water source control valve 246. Some of the water provided to the humidifier pad may reach the bottom of the humidifier pad. This water 250 may be collected by a collection tray and routed and expelled to a drain of the building by a water drain pipe 248.

Humidifier 140 of FIG. 1 and Humidifier 240 of FIG. 2 each is shown coupled to a water drain pipe 148, 248 for removing un-evaporated water 150, 250. Sending un-evaporated tap water down the drain of a building may be considered a waste of water. Typically, in conventional operation, water source control valve 146, 246, which may be a solenoid actuated valve or any other suitable valve, deliver water to the humidifier pad during the entire call for humidity. That is, water is provided the humidifier pad during the entire time period that a call for humidity is active. Under some conditions, a call for humidity can last for a substantial amount of time (e.g. hours or even days). It has been found that under many operation conditions, more water is lost down the water drain of the building than is evaporated into the HVAC air stream. In some cases, the ratio of drained water to evaporated water may be approximately three to one. In addition to the waste of water, energy may be wasted in heating the water, as the water 144, 244 is often drawn from a domestic hot water source, for enhanced evaporation compared to cold water. Also, the un-evaporated water 150, 250 may generally flow to a sewer or septic system, creating a further burden.

In at least some illustrative embodiments, the present disclosure provides humidifiers with new configurations of humidifier components and/or control methods. Possible advantages that may be realized in some illustrative embodiments include more efficient operation, more compact enclosures, more convenient installation, quieter operation, and easier maintenance. Generally, any feature of any embodiment of a humidifier described herein may be combined with or added to any other embodiment to the extent that it is compatible. While some features may be shown and/or discussed in association with either a bypass type humidifier or a fan powered humidifier, such features may be used with either type of humidifier when compatible.

In at least some illustrative embodiments, humidifiers and methods are provided to help reduce this water waste. In general, any suitable humidifier may be configured to reduce water waste as disclosed herein, and methods of reducing water waste as disclosed herein may be practiced with any suitable humidifiers, such as bypass and fan powered humidifiers, including those of FIGS. 1 and 2.

In some illustrative embodiments, water is delivered to a humidifier pad for substantially less than the entire duration of a call for humidity time interval. For example, water may be delivered in pulses in, for example, a one minute on, one minute off pattern, a one minute on, two minute off pattern, or any other suitable pattern as desired. A one minute on, one minute off pattern of pulsed water delivery may be described as having a 50% duty cycle and two minute period or frequency.

Figure 3:
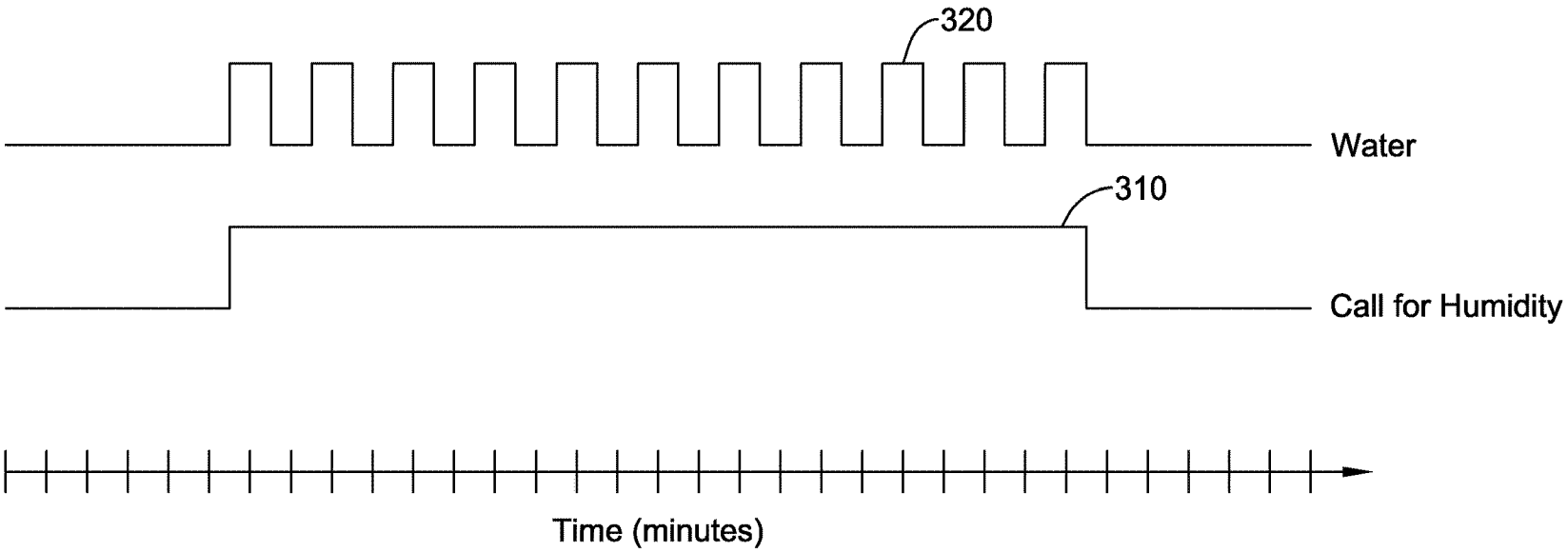
FIG. 3 is a timing chart showing an illustrative water delivery pattern that may be employed when operating a humidifier, such as the illustrative humidifiers of FIGS. 1 and 2.

FIG. 3 is a timing chart showing an illustrative water delivery pattern that may be employed when operating a humidifier, such as the illustrative humidifiers of FIGS. 1 and 2. Trace 310 represents a call for humidity signal for an HVAC system, with high portions of the trace representing a call for humidity, and low portions representing the lack of a call for humidity. Trace 320 represents water delivery to a humidifier pad within the humidifier, with high portions representing water delivery (e.g. water valve open), and low portions representing non-delivery (e.g. water valve closed). In some cases, a controller is provided for controlling a water valve that delivers water to the humidifier pad. The controller may be configured to cause the valve to deliver water to the humidifier pad during a call for humidity but for substantially less of the time than the entire call duration of the call for humidity.

The water delivery pattern shown in FIG. 3 is a pulsed on-off pattern with a 50% duty cycle and a relatively short period relative to the length of the call for humidity 310. However, it is also contemplated that the water delivery pattern may have a duty cycle of 90%, 50%, 30%, 20% or any other suitable duty cycle, depending on the circumstances, and the period or frequency of about ten seconds, one-half minute, one-minute, two-minutes, four-minutes, or any other suitable period of frequency. Also, it is contemplated that the duty cycle and/or period or frequency may vary over time and/or with changing conditions. It is also contemplated that the water delivery pattern may be any suitable pattern or have any suitable characteristic, such as periodic, non-periodic, pseudo-periodic, pseudo-random, random or have the water modulated in any other suitable manner that results in water being delivered to the humidifier pad for less time than the entire duration of a corresponding call for humidity.

The duty cycle, period/frequency, and other parameters of a water delivery pattern may be tailored for a desired result. For example, if a low frequency and low duty cycle are used, the moisture levels in the humidifier pad may decline significantly between water deliveries, which may reduce the rate of transfer of humidity to HVAC air. Conversely, a high frequency and high duty cycle may result in maintenance of moisture in a humidifier pad, resulting in a higher rate of humidity transfer to HVAC air, but some water may not be retained by the humidifier pad resulting in some wasted water. At some frequency/duty cycle combinations, the rate of humidity transfer to HVAC air may not differ substantially from a rate of humidity transfer resulting from an always-on delivery of water to the humidifier pad, but will result in less wasted water out the drain pipe.

In some illustrative embodiments, a water delivery pattern may be used that achieves a targeted humidity transfer rate, while reducing wasted water. In some illustrative embodiments, the targeted humidity transfer rate is substantially similar to a humidity transfer rate resulting from a continuously wetted humidifier pad, but this is not required in all embodiments.

Features of water delivery patterns may be selected for other reasons as well. In some illustrative embodiments, a frequency characterizing a water delivery pattern may be selected to limit the number of openings and closings of a water source control valve. This may help increase the lifetime of the water source control valve. In another example, a water delivery pattern may be selected to result in delivery of hot water from a water heater to the humidifier pad. Because water in a water source line may cool down between water draws, the initial water draw during a call for humidity may be extended to help purge the cooled water from the line and deliver hot water to the humidifier pad. The temperature of water delivered to the humidifier pad may affect the humidity transfer rate of the humidifier.

In some illustrative embodiments, a humidifier executes essentially the same water delivery pattern during each call for humidity. In other illustrative embodiments, different water delivery patterns may be executed during different calls for humidity, and/or during different times during a particular call for humidity.

In some illustrative embodiments, the water flow rate that is delivered by the water valve may be modulated. That is, instead of a pulsed on-off pattern, or in addition to, it is contemplated that the water flow rate may be modulated by a controller over time. In such an embodiment, the water flow rate may be increased during certain times of a call for humidity and decreased at other times. In some cases, the water flow rate may remain between 0% and 100% of the flow rate of the water valve during the entire call for humidity. In other cases, the water flow rate may reach 100% and/or 0% during some parts of a call for humidity.

Figure 4:
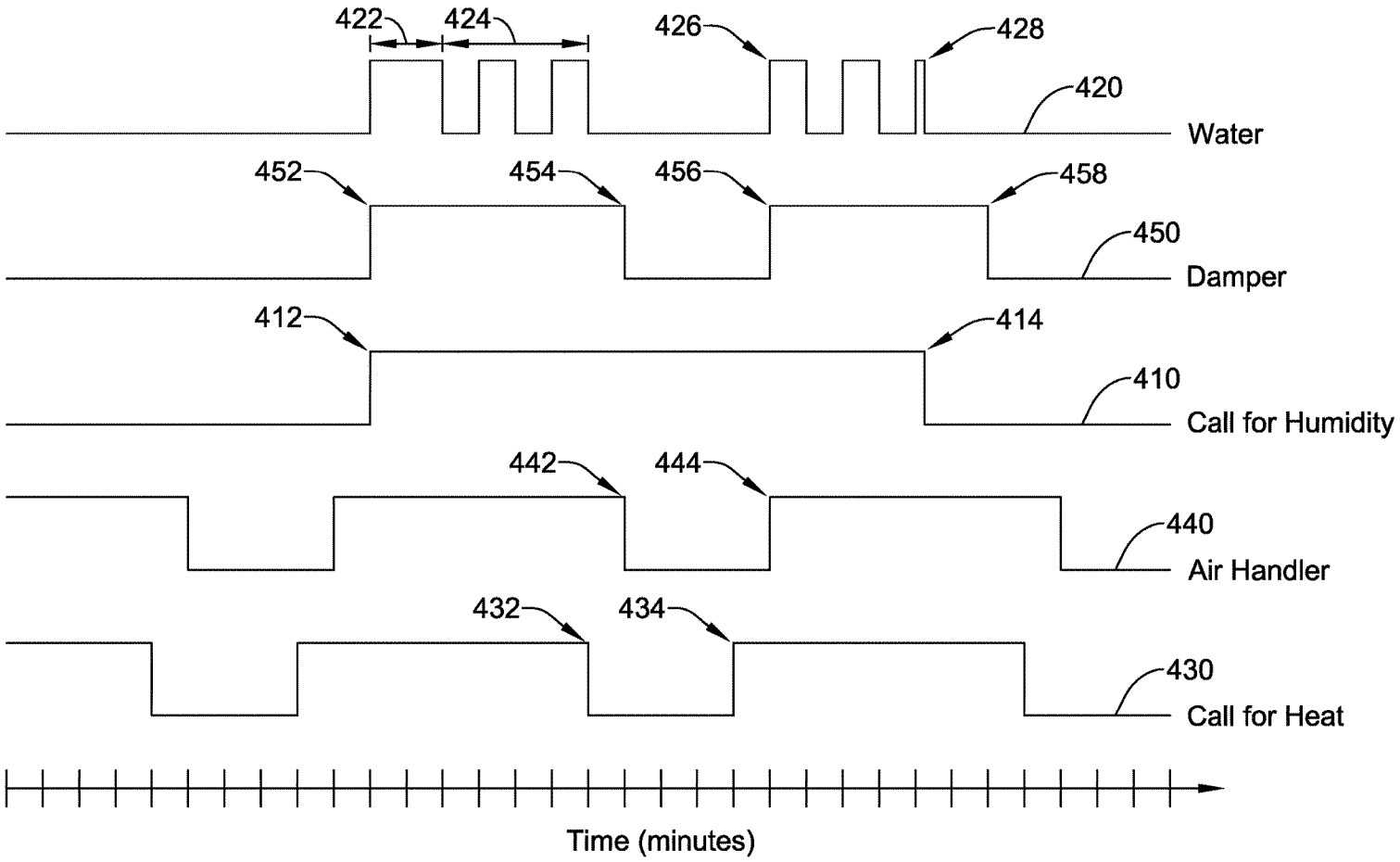
FIG. 4 is a timing chart showing an illustrative control signal pattern that may be employed when operating an illustrative HVAC system and humidifier.

FIG. 4 is a timing chart showing an illustrative control signal pattern that may be employed when operating an illustrative HVAC system and humidifier. Trace 410 represents a call for humidity signal for an HVAC system, and trace 420 represents water delivery to the humidifier pad. In the illustrative embodiment, and at the onset of a call for humidity at 412, water is delivered to the humidifier pad for an extended first period or pulse 422, followed by another period 424 that may be characterized by a frequency and a duty cycle. The extended first period 422 may serve, for example, to purge a water source line of cool water, so that hot water may be delivered to the humidifier pad. After the extended first period 422, the water in the water source line may remain warm to more effectively contribute toward achieving a targeted humidity transfer rate during the period 424.

In an illustrative timing chart, an HVAC system may be configured to prevent water delivery to a humidifier pad, even during a call for humidity, in the absence of a call for heat. This may be done, for example, because evaporation from a humidifier pad may be substantially suppressed in the absence of a warm airflow and possibly an accompanying shutdown of forced airflow. This is illustrated in FIG. 4, where the period of water delivery 424 ends in coincidence with the end of a call for heat at 432. Another call for heat commences at 434. Trace 440 represent operation of an air handler, with high and low respectively representing forced airflow and the absence of forces air flow. The air handler starts at 444, following a short delay after the call for heat at 434; this may be programmed, for example, to allow a furnace heat exchanger to reach an operating temperature before transferring heat from the exchanger via airflow. Upon commencement of airflow at 444, another period of pulsed water delivery starts at 426. The restarted water delivery may commence with an extended first period or pulse—for example, when such an extended pulse may serve to bring warmer water to the humidifier pad. Such an extended pulse is not required. Water delivery stops at 428 with the end of the call for humidity at 414.

Water source control valves such as valves 146 and 246 of FIGS. 1 and 2 may provide physical control over the flow of water to the humidifier, although any suitable mechanism may be used. Commands to start or stop water flow may be generated by a humidifier controller. In some illustrative embodiments, a timer controls the water control supply valve. The timer may incorporate a mechanical, electronic, or any other suitable timer mechanism. In some illustrative embodiments, a timer may, in response to a call for humidity, provide a simple periodic on-off control signal with a duty cycle and a period/frequency, and in the absence of a call for humidity, provide only the off signal. In some illustrative embodiments, more sophisticated water delivery patterns may be commanded by a timer. It is contemplated that the timer may be incorporated into or may be provided by a controller. It is contemplated that the controller may be located proximal to a water source control valve that it commands, or it may be located at a distance and communicatively coupled to the valve. The controller may be considered subservient to or part of an HVAC controller. For example, and in some embodiments, the timer function may be incorporated within an HVAC controller as part of a control program executed by the controller, for example, as software executed by a microprocessor. In some embodiments, the humidifier may include a humidifier controller that includes the timer function, and the humidifier controller may receive a call for humidify from an HVAC controller such as a thermostat, humidistat or other HVAC controller, and then generate the appropriate control signal for the water delivery control valve of the humidifier.

A water delivery pattern for controlling delivery of water to a humidifier pad may be specified in any suitable manner. For example, the timer function for controlling the water delivery control valve may incorporate a pattern, such as a periodic pattern that includes a duty cycle and a period/frequency that is fixed at time of manufacture. Alternately, the timer function may allow for setting of water delivery pattern parameters by an installer or HVAC system end user. Likewise, it is contemplated that a water delivery pattern program may be incorporated into an HVAC controller, with such a program being fixed at time of controller manufacture, and/or such program software being programmable at a later time such as in the field.

In some cases, a humidifier or humidifier system may include or more sensors for detecting at least one property associated with the operation of the humidifier to help control the water delivery control valve. For example, the humidifier or humidifier system may detect, for example, humidity of air downstream of the humidifier pad, the amount of moisture at one or more physical locations of the humidifier pad, the presence of water in a drain of the humidifier, the temperature of the water in the drain of the humidifier, and/or any other suitable parameters as desired. The humidifier and/or HVAC controller may be configured to use the dynamically measured data from such a sensor or sensors to help determine a demand for water for a humidifier and to control delivery of water to the humidifier pad. Such control may be accomplished by adjusting parameters of the water delivery pattern, such as the duty cycle and period/frequency. In some cases, such measured data may be used in a feedback control path to control when water is needed in the humidifier pad, and to delivery water only during those times. It is contemplated that a humidifier and/or HVAC controller may use historical data, sometimes in combination with present-time data, to determine or predict demand for water and to control delivery of water to the humidifier pad.

Control of delivery of water to the humidifier pad as disclosed herein may result in water savings compared to conventional humidifier systems for forced-air HVAC systems where water is delivered continuously to the humidifier pad during a call for humidity. In a conventional continuous water delivery system, 75% or more of the water delivered to the humidifier pad may be wasted. When water is not continuously delivered to the humidifier pad, it is contemplated that less than 70%, 50%, 30%, 10% or less of the water that is delivered to the humidifier pad may drain from the humidifier pad during a call for humidity.

As noted above, in some illustrative embodiments, the water flow rate that is delivered by the water valve may be modulated. In such an embodiment, the water flow rate may be increased during certain times of a call for humidity and decreased at other times. In some cases, the water flow rate may remain between 0% and 100% of the flow rate of the water valve during the entire call for humidity. In other cases, the water flow rate may reach 100% and/or 0% during some parts of a call for humidity. Modulating the flow rate of the water valve may be used instead of, or in conjunction with, the pulsed on-off embodiments discussed above.

Figure 5:
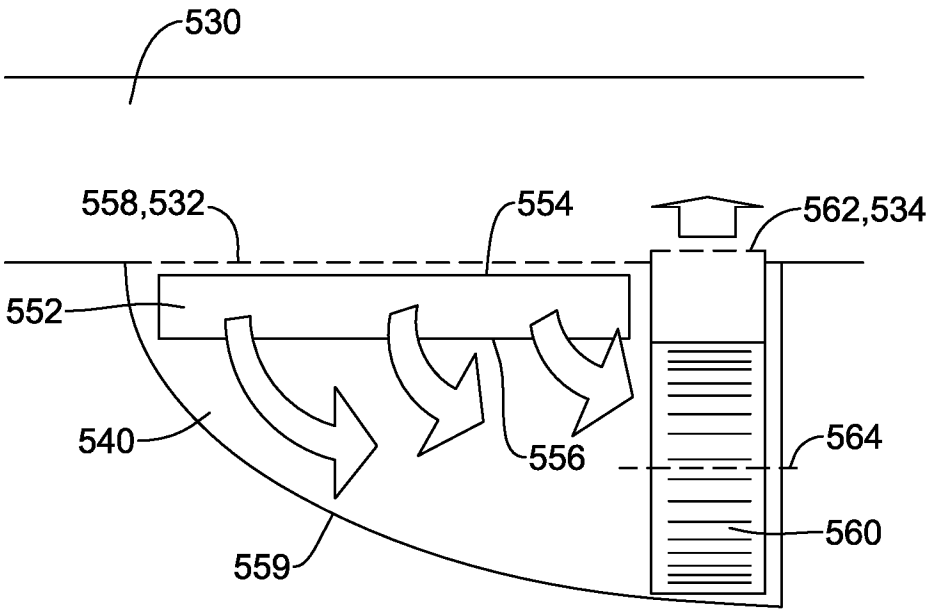
FIG. 5 is a schematic side view showing an illustrative fan-assisted humidifier that includes a humidifier pad that extends substantially parallel with a mounting surface of a duct.

FIG. 5 is a schematic side view showing an illustrative fan-assisted humidifier 540 that includes a humidifier pad 552 that extends substantially parallel with a mounting surface of an HVAC duct 530. More specifically, the illustrative humidifier 540 includes a humidifier pad 552 having a first major surface 554 and an opposing second major surface 556. The first major surface 554 of the humidifier pad 552 is disposed proximal to, and in fluid communication with, an air intake 558 of the humidifier, which is an air flow aperture defined by the housing 559 of the humidifier 540. The humidifier pad 552 may be referred to as a stationary humidifier pad, in contrast with humidifier pads in some humidifier devices that are set into motion, for example, to rotate through a water reservoir. The air intake 558 is disposed proximal the HVAC duct 530 and is configured to fluidly communicate with the air inside of the duct via a duct opening 532. In the illustrative embodiment, duct opening 532 defines a first plane, which, as illustrated in FIG. 5, may be parallel with a second plane defined by first major surface 554 of the humidifier pad 552. The first plane defined by the duct opening 532 may also be substantially parallel with a plane defined by air intake 558.

The illustrative fan powered humidifier 540 includes a fan 560 disposed to the side of humidifier pad 552. Fan 560 is shown as a centrifugal blower, but it is contemplated that any suitable fan may be used. Fan 560 is configured to return air to HVAC duct 530 via an air outlet port 562, which is an air flow aperture defined by the housing 559 of the of the humidifier 540 that is in fluid communication with a duct opening 534. In some illustrative embodiments, duct opening 534 and duct opening 532 are both the same opening in the duct, while in other embodiments they are separate openings.

In FIG. 5, the fan powered humidifier 540 is configured such that air from HVAC duct 530 is drawn into the humidifier through duct opening 532 and air intake 558, drawn or propelled by the fan 560 though the moistened humidifier pad 552, and returned to the duct via air outlet port 562. In other illustrative embodiments, the air flow may essentially be reversed, with air flow apertures 558 and 562 reversing intake/outlet roles.

In comparison with a conventional fan powered humidifier, a number of advantages may be realized by a humidifier having features of humidifier 540. Conventional fan powered humidifiers typically employ an axial fan, which is disposed proximate the interior major surface of the humidifier pad (e.g., second major surface 556). Accessing the humidifier pad for replacement generally involves removing the axial fan, complicating maintenance. In contrast, with humidifier 540 of FIG. 5, the location of fan 560 to the side of the humidifier pad 552 may allow easier access/replacement of the humidifier pad 552. Another consequence of the typical conventional location of an axial fan is that air needs to reverse direction 180 degrees to return to the duct, in a limited space or volume, resulting in turbulence and noise. In contrast, in illustrative humidifier 540, a smoother flow of air through the humidifier may result in lower turbulence and noise levels. Another advantage of illustrative humidifier 540 is that the centrifugal fan may be capable of achieving a higher pressure rise, with the result that outlet port 562 may have a smaller area than an outlet port of a humidifier using, for example, an axial fan, yet still maintain an equivalent air flow rate. A smaller outlet port 562 may enable a smaller humidifier design.

As schematically illustrated in FIG. 5, the illustrative humidifier 540 is shown as having a centrifugal fan 560 configured with its rotation axis 564 parallel to the plane defined by air intake 558. In other illustrative embodiments, a humidifier fan 560 may be configured differently, for example, adjacent the second major surface 556 of the humidifier pad 552, with a rotation axis 564 being perpendicular to the plane defined by air intake 558. Such a humidifier configuration may still realize the advantage of employing a fan capable of achieving a higher pressure rise, compared to alternative axial fans.

Figure 6:
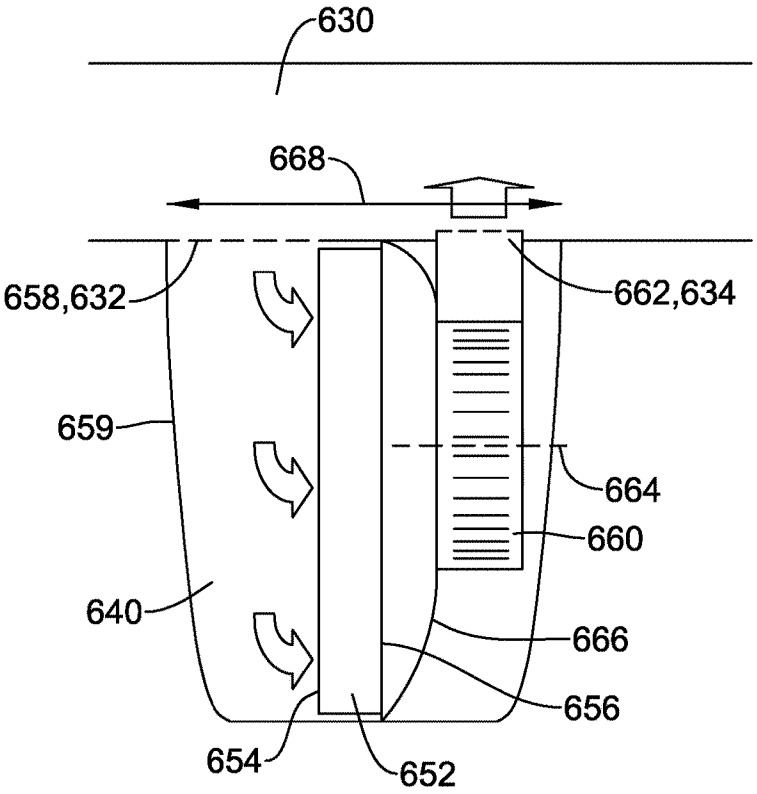
FIG. 6 is a schematic side view showing an illustrative fan-assisted humidifier that includes a humidifier pad that extends substantially perpendicular to a mounting surface of a duct.

FIG. 6 is a schematic side view showing an illustrative fan-assisted humidifier 640 that includes a humidifier pad 652 that extends substantially perpendicular to a mounting surface of an HVAC duct 630. The illustrative humidifier 640 includes a humidifier pad 652 having a first major surface 654 and an opposing second major surface 656. Humidifier 640 also includes an air intake 658, which is an air flow aperture defined by the housing 659 of the humidifier. The air intake 658 is disposed proximal the HVAC duct 630 and is configured to interface, or fluidly communicate with the interior of the HVAC duct 630 via a duct opening 632. Duct opening 632 and air intake 658 may be substantially parallel, and either one or both may define a first plane. As illustrated in FIG. 6, the humidifier pad 652 may be disposed in humidifier 640 such that a second plane defined by the first major surface 654 of the humidifier pad 652 is substantially non-parallel with the first plane defined by 658,632. In some illustrative embodiments, the second plane is substantially perpendicular to the first planed defined by 658,632. Regardless of the relative orientation, the humidifier pad 652 and air intake 658 are shown in fluid communication.

The illustrative humidifier 640 of FIG. 6 may include a shroud 666 disposed adjacent to the second major surface 656 of the humidifier pad 652, which when provided, may serve as an interface between the humidifier pad and fan 660. The shroud 666 may help direct air flow substantially across the entire area of second major surface 656 of the humidifier pad 652, and direct the air to the fan 660 for return to the HVAC duct 630. In the illustrative embodiment of FIG. 6, the fan 660 is shown as a centrifugal fan or blower having an axis of rotation 664 parallel to the first plane of the duct opening 632 and air intake 658. Fan 660 is configured to return air to HVAC duct 630 via an air outlet port 662, which in the illustrative embodiment, is an air flow aperture defined by the housing 659 of the of the humidifier 640 that is in fluid communication with a duct opening 634. In some illustrative embodiments, duct opening 634 and duct opening 632 are both the same opening in the duct, while in other embodiments they are separate openings.

In FIG. 6, air from HVAC duct 630 is drawn into the humidifier 640 through duct opening 632 and air intake 658, drawn or propelled by the fan 660 though the moistened humidifier pad 652, and returned to the duct via air outlet port 662. In other illustrative embodiments, the air flow pattern may be reversed, with air flow apertures 658 and 662 reversing intake/outlet port roles.

For humidifier 640 of FIG. 6, it is contemplated that air intake 658 may have an air intake area substantially less than the area of the first major surface 654 of the humidifier pad 652. In some illustrative embodiments, the ratio of the air intake area to the area of the first major surface 654 of the humidifier pad 652 is less than about 80%, 60%, 40%, 20% or less. In contrast, the air intake 558 of humidifier 540 of FIG. 5 is configured to have approximately the same area as first major surface 554 of humidifier pad 552, which is disposed proximal the air intake. By decoupling the placement of the humidifier pad 652 from the location of the air intake 658, air intake 658 may be made smaller in area than in configurations where the humidifier pad essentially occupies or is otherwise parallel with the air intake aperture. This may allow the area of the side of the humidifier 640 that interfaces with the HVAC duct 630 to be smaller. For example, the width 668 of the humidifier 640 may be substantially less than what would be necessary to accommodate the length or width of the first major surface 654 of humidifier pad 652.

When either the air intake or air outlet (or both) of an illustrative humidifier has a smaller area than one found in a conventional humidifier, resistance to airflow may be increased. In such a design, a fan capable of achieving a higher pressure rise such as a centrifugal fan may be used to maintain an equivalent air flow rate in view of the higher resistance to air flow. Higher pressure rise fans may be useful in humidifiers having higher resistance to air flow attributed to other design characteristics as well.

The economy in width 668 of humidifier 640 made possible by the substantially perpendicular (or at least non-parallel) orientation of the humidifier pad 652 with respect to the air intake 658 may allow greater flexibility for placement of the humidifier. This may allow the illustrative humidifier 640 to be mounted in places that other humidifiers may not.

Figure 7:
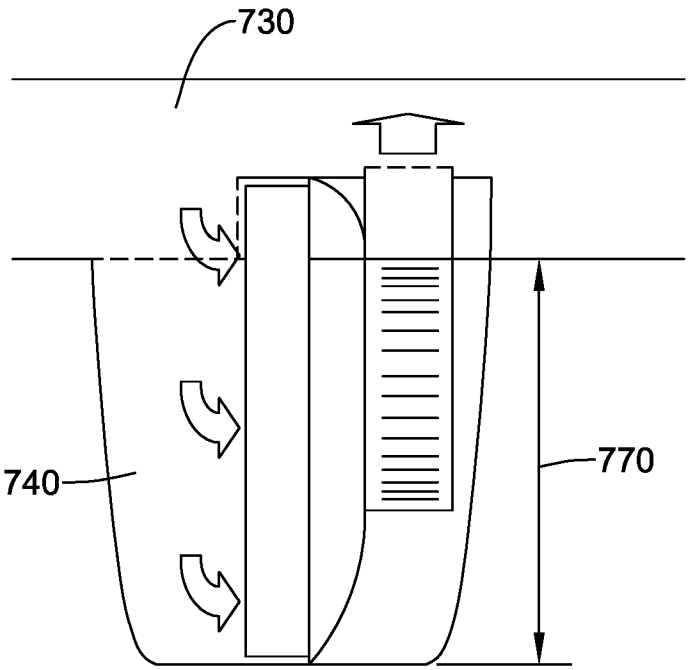
FIG. 7 is a schematic side view showing another illustrative fan-assisted humidifier that includes a humidifier pad that extends substantially perpendicular to a mounting surface of a duct.

Another place where space is often limited is the region immediately exterior to a duct. FIG. 7 is a schematic diagram of another illustrative fan assisted humidifier 740 shown attached to an HVAC duct 730. Humidifier 740 is configured such that it is partially inserted into the duct 730, which may decrease the exterior depth 770 of the humidifier 740. Such a configuration may make installation of the humidifier 740 possible, or easier, in locations where space exterior to the duct 730 is limited, as compared with conventional humidifier designs. In some illustrative embodiments, at least about 5%, 10%, 20%, 30% or more of the volume displaced by humidifier 740 may be disposed within HVAC duct 730. As with humidifier 540 of FIG. 5, the illustrative humidifiers 640 and 740 of FIGS. 6 and 7 respectively may also allow smoother air flow paths as compared to conventional fan assisted humidifiers, which may result in lower turbulence and noise.

Figure 8:
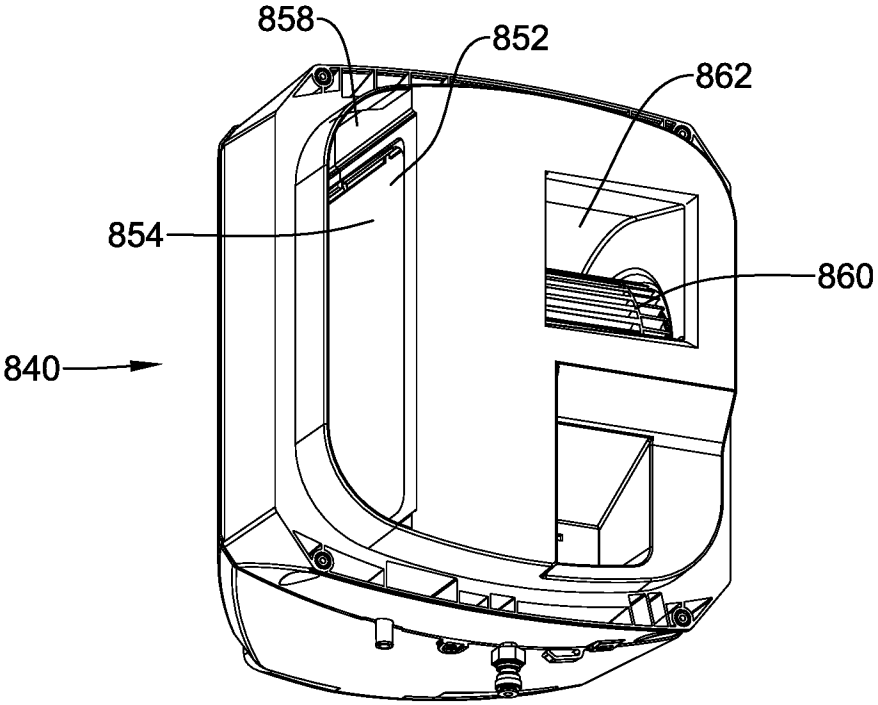
FIG. 8 is a perspective back view showing the back side of an illustrative fan-assisted humidifier that includes a humidifier pad that extends substantially perpendicular to a mounting surface of a duct, shown from the back or duct mounting side of the humidifier.

FIG. 8 is a perspective back view showing the back side of an illustrative fan-assisted humidifier 840 that includes a humidifier pad 852 that extends substantially perpendicular to a mounting surface of a duct, shown from the back or duct mounting side of the humidifier 840. This illustrative humidifier 840 shares some features with humidifiers 640 and 740 of FIGS. 6 and 7. Through air intake 858, the first major surface 854 of humidifier pad 852 is visible. In this illustrative embodiment, the area of air intake 858 is substantially less than the area of first major surface 854. Through air outlet port 862, fan 860 is visible, shown as a centrifugal fan or blower. In this illustrative embodiment, the combined areas of air intake 858 and outlet port 862 are less than the area of the first major surface 854 of the humidifier pad. In some illustrative embodiments, the area of a side of a humidifier 840 that is configured to interface with the HVAC duct is less than the area of a major surface of a humidifier pad of the humidifier 840.

Figure 9:
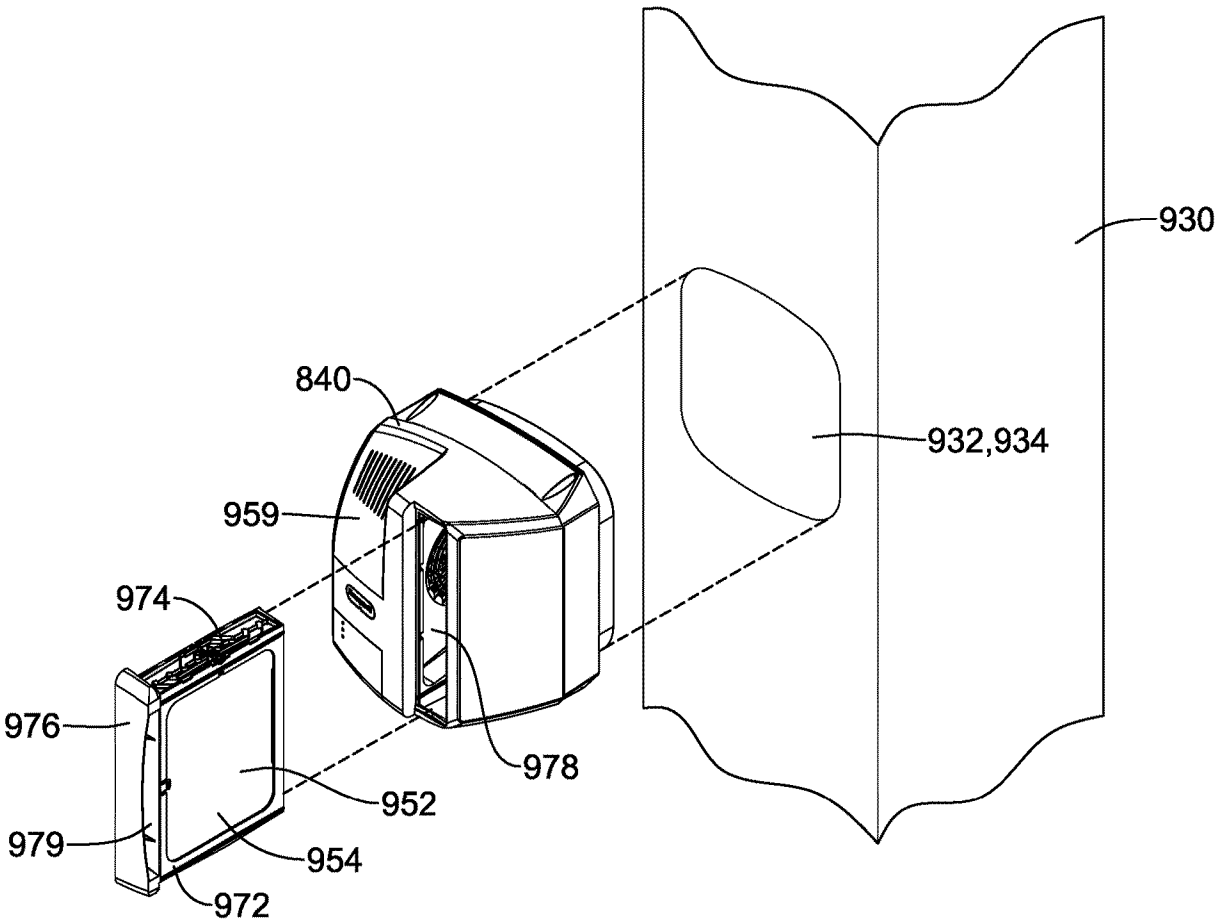
FIG. 9 is a perspective front view showing the front side of the illustrative fan-assisted humidifier of FIG. 8 shown spaced-apart from an associated HVAC duct.

FIG. 9 is a perspective front view showing the front side of the illustrative fan-assisted humidifier 840 of FIG. 8, shown spaced-apart from an associated HVAC duct 930. In this illustrative embodiment, the air intake and outlet port apertures (not visible in this view) fluidically communicate with the interior of HVAC duct 930 through a common duct opening 932, 934. Humidifier pad 952 is shown with a pad frame 972, water distributor 974, and cover member 976.

In the illustrative embodiment, pad frame 972 may serve to position or hold the humidifier pad 952 in an operating position within the humidifier 840. In some cases, the pad frame 972 may also provide structures that assist a user in repeatedly and reliably achieving such positioning. The pad frame 972 may provide a user performing maintenance or replacement with a convenient way for handling the humidifier pad 952.

In the illustrative embodiment, water distributor 974 may be employed to help distribute water from a water source evenly over the top edge of the humidifier pad 952. The water that engages the humidifier pad 952 then moves under the force of gravity to fill a large fraction of the humidifier pad's volume, though other arrangements are possible. In some embodiments, the water distributor 974 may be mechanically connected to a water sources such that deliberate mechanical manipulation is required to disconnect and reconnect the water distributor 974 from/to its water source, when, for example, removing and replacing the humidifier pad 952. For example, such deliberate mechanical manipulation may entail manually unclamping and clamping a water hose to the water distributor.

In the illustrative embodiment of FIG. 9, the water distributor 974 may be configured without direct mechanical connections to a water source, and thus deliberate mechanical manipulation for disconnection and reconnection a water source to the water distributor 974 may not be required. For example, the humidifier may be configured such that water distributor 974 may be place into and removed from an operational configuration, where fluidic coupling and decoupling of the water distributor 974 with respect to a water source may be achieved and broken intrinsically as part of the placement and removal process, without additional deliberate mechanical effort required. In some cases, a water source within the humidifier 840 may simply drop water onto the top surface of the water distributor 974 when the humidifier pad 952, pad frame 972, water distributor 974 are inserted into the humidifier housing 959 of the humidifier 840.

As illustrated in FIG. 9, humidifier pad 952, pad frame 972, water distributor 974, and cover member 976 may be joined together to form an assembly that is slidably accessible through an access port or aperture 978 in the housing 959 of humidifier 840. In some cases, cover member 976 may include a handle 979 to facilitate such manipulation. When removed from the humidifier 840, the assembly may be separated at least in part such that the humidifier pad 952 may be replaced with a new humidifier pad. The assembly may then be rejoined and re-installed into the humidifier 940. When the assembly is installed, and in the illustrative embodiment, cover member 976 may substantially cover or close access port 978.

In some illustrative embodiments, not all of elements 952, 972, 974, and 976 necessarily are joined to form an assembly slidably removable from humidifier 940. For example, in some illustrative embodiments, cover member 976 may be removed from access port 978 by itself, and humidifier pad 952 may be slidably accessed through the access port in a direction parallel to the plane of the first major surface 954 of the pad. In one such illustrative embodiment, pad frame 972 may allow such slidable access to the pad 952 through a side of the pad frame. In another illustrative embodiment, the pad 952 and pad frame 972 may be accessed together through the access port after removal of the cover member 976. In yet another illustrative embodiment, the pad 952 and water distributor 974 may be accessed together through the access port after removal of the cover member 976. In another illustrative embodiment, the joined cover member 976, pad frame 972, and pad 952 may be slidably removed via the access port 978, leaving the water distributor 974 in place in the humidifier 940.

While the illustrative embodiments of FIGS. 6-9 are shown as fan assisted humidifiers, bypass humidifiers may include similar compatible features, if desired. For example, a humidifier pad placed substantially perpendicular (or at least non-parallel) with respect to an air intake may be incorporated into a bypass humidifier to achieve, for example, a smaller air intake. Similarly, bypass humidifiers with less width and/or (external) depth can be achieved, as in the cases of the fan assisted humidifiers illustrated in FIGS. 6 and 7. The slidably accessible humidifier pad configurations described with respect to FIG. 9 may also be incorporated into bypass humidifiers. These are just examples.

Figure 10:
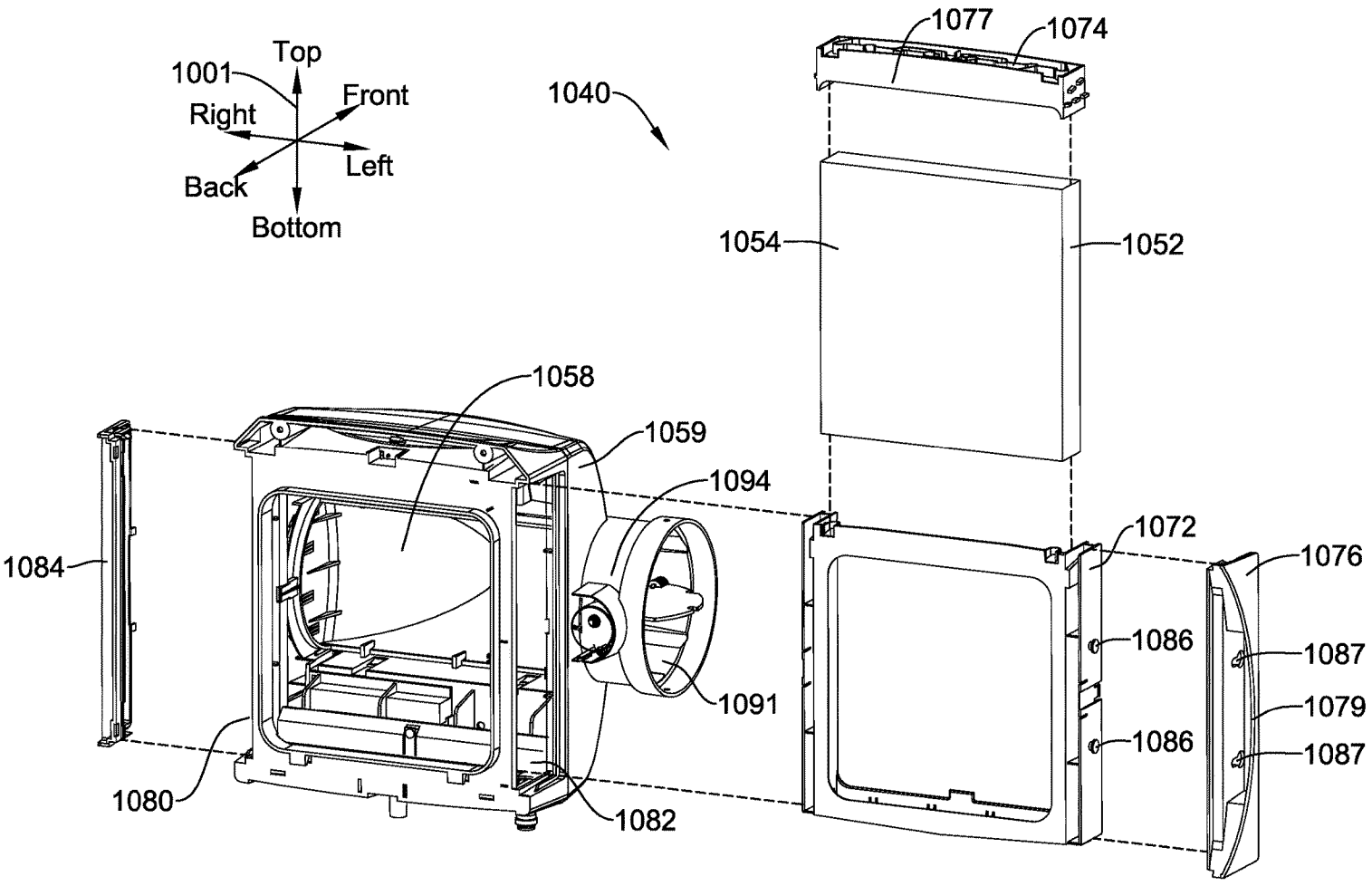
FIG. 10 is a schematic partially-exploded back view of an illustrative bypass humidifier with a side loadable humidifier pad.
Figure 11:
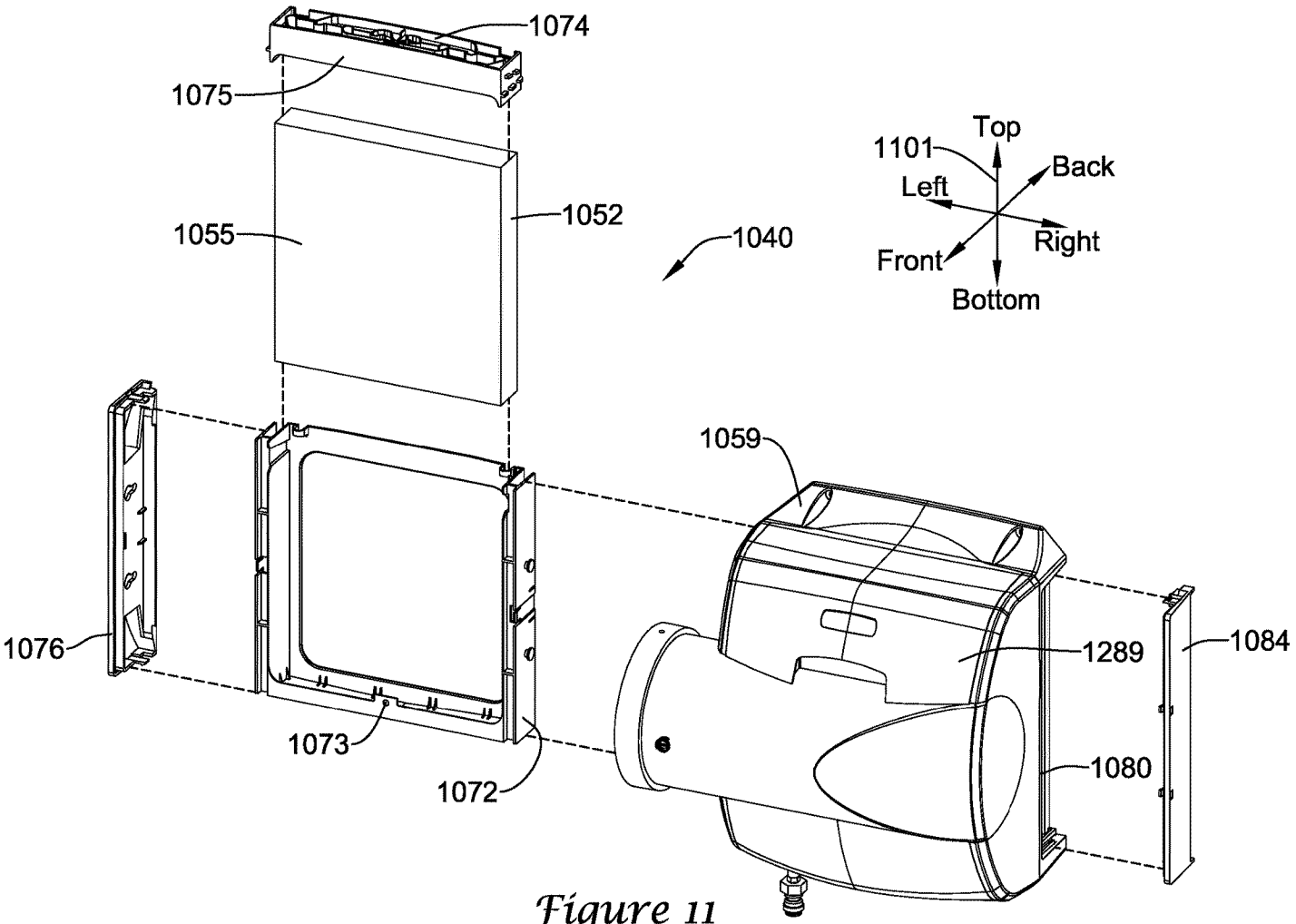
FIG. 11 is a schematic partially-exploded front view of the illustrative bypass humidifier of FIG. 10.

Further illustrative embodiments having improved access to humidifier pads for replacement or maintenance are described herein. For example, FIG. 10 is a schematic partially-exploded back view of an illustrative bypass humidifier 1040 with a side loadable humidifier pad 1054. A key 1001 is provided to show the relative nomenclature used in describing the embodiment of FIG. 10. FIG. 11 is a schematic partially-exploded front view of the illustrative bypass humidifier of FIG. 10. A key 1201 is provided to show the relative nomenclature used in describing the embodiment of FIG. 11.

The back side of the humidifier 1040 is configured to be attached to an HVAC duct. The so-called left and right sides of the humidifier 1040 are seen on the right and left sides in FIG. 10 and on the left and right sides in FIG. 11. While a bypass humidifier is illustrated and discussed with reference to FIGS. 10 and 11, it is contemplated that the humidifier pad access discussed therein may be applied in fan assisted and other types of humidifiers, if desired.

Referring to FIGS. 10 and 11, humidifier 1040 includes a replaceable humidifier pad 1052, which is held in an operating position during operation of the humidifier by a housing 1059. In the illustrative embodiment, humidifier housing 1059 defines multiple apertures including an air flow aperture 1058, which may be an air intake or outlet depending on whether humidifier 1040 is mounted on a supply or return duct, respectively. When the humidifier pad 1052 is held in the operating position, its first major surface 1054 is substantially parallel to the plane defined by air intake/outlet 1058, although other orientations for the humidifier pad 1052 are contemplated. Humidifier housing 1059 also defines at least one of right side access aperture or port 1080 and left side access port or aperture 1082. In the illustrative embodiment, each access aperture 1080, 1082 is sufficient in size to remove the replaceable humidifier pad 1052 from the humidifier housing 1059 and install a new humidifier pad.

When both right 1080 and left 1082 access apertures are provided, humidifier 1040 may be configurable to allow the removal and replacement of the humidifier pad 1052 from either side, or both sides. This may provide an HVAC installer, maintainer, and/or end-user significant flexibility when accessing the humidifier pad 1052. Right 1080 and left 1082 side access apertures may be identically configured, configured with mirror symmetry, or configured in any other suitable manner, as desired. In other illustrative embodiments, a humidifier housing may include only one of a right or left side access aperture, when desired.

In the illustrative embodiment, humidifier 1040 includes a pad frame 1072, water distributor 1074, and cover member 1076. Humidifier pad 1052, pad frame 1072, water distributor 1074, and cover member 1076 are shown separated from each other and external to the humidifier housing 1059 in FIG. 10. In the illustrative embodiment of FIG. 10, cover member 1076 substantially covers or closes the left side access aperture 1082 when in its operating installed position. The description of humidifier pad 1052 access through the left side access aperture 1082 in FIG. 10 is merely exemplary. Access through the right side access aperture 1080 may be practiced in a like manner.

In a manner similar to that possible for the corresponding parts of FIG. 9, these components, or subsets thereof, may be joined together to form an assembly that is slidably accessible through left side access aperture 1082. Cover member 1076 may include a handle 1079 to facilitate manipulation. When removed from the humidifier 1040, the assembly may be separated at least in part such that humidifier pad 1052 may be replaced with a new humidifier pad. The assembly may then be rejoined and re-installed into the humidifier 1040.

In some illustrative embodiments, water distributor 1074 and pad frame 1072 are configured such that the water distributor is releasably attachable to the frame along a top side of the frame. At least one retention structure (not shown) may be provided to releasably retain the water distributor relative to the frame. Any suitable retention structure(s) may be used. In some illustrative embodiments, the water distributor 1074 is configured to release from the pad frame 1072 in a forward direction, toward the front side of the frame.

Water distributor 1074 may cover, cap, straddle, or otherwise mechanically engage humidifier pad 1052 along the top side of the pad. Any suitable structure(s) may be used for such engagement, which may help the water distributor 1074 retain the humidifier pad 1052 in position in the frame 1072. Water distributor 1074 may include a front flange 1075 as shown in FIG. 11 that extends down over a portion of the front major surface 1055 of the humidifier pad 1052 along the top side of the pad when the water distributor is attached to the frame 1072. The front flange 1075 may retain the humidifier pad 1052 in the frame 1072 when the water distributor is attached to the frame. The water distributor 1074 may include a back flange 1077 as shown in FIG. 10 that extends down over a portion of the back major surface 1054 of the humidifier pad 1052 along the top side of the pad when the water distributor is attached to the frame 1072. Individually or together, front flange 1075 and/or back flange 1077 may engage water distributor 1074 with humidifier pad 1052 while the water distributor is attached to the frame 1072, and also potentially when the water distributor is released from the frame. This engagement of the water distributor 1074 and humidifier pad 1052 may allow the two parts to maintain a substantially fixed mechanical relationship with each other during manipulations as described herein. In an illustrative embodiment, the following steps are performed to replace a humidifier pad in a humidifier pad assembly that has been removed from a humidifier. The water distributor 1074 is grasped and pulled forward relative to the frame 1072 to release the water distributor from the frame. As the water distributor 1074 is pulled forward, the mechanical engagement of the water distributor with the humidifier pad 1052 helps the two components pivot forward together relative to the frame 1072 about a bottom edge of the humidifier pad disposed in the frame. The frame 1072 is structured to permit removal and replacement of the humidifier pad 1052 through its front side, being substantially free of obstructions on the front side. The frame 1072 may also be structured to permit removal and replacement of the humidifier pad 1052 through its top side, also being substantially free of obstructions on the top side. Once the water distributor 1074 is disengaged from the frame 1072, the humidifier pad 1052 and the water distributor may be removed from the frame, either together or separately. A replacement humidifier pad may then be placed in the frame 1072, bottom edge first, and the water distributor 1074 engaged with the top side of the pad. The humidifier pad 1052 and water distributor 1074 are pivoted together backward in the frame 1072, and the water distributor is pushed into the frame until it attaches to the frame.

In some illustrative embodiments, not all of elements 1052, 1072, 1074, and 1076 necessarily are joined to form an assembly that is slidably removable from humidifier 1040. In some illustrative embodiments, cover member 1076 may be removed from left side aperture 1082 by itself, and humidifier pad 1052 may be slidably accessed through the access port in a direction parallel to the plane of the first major surface 1054 of the pad. In one such illustrative embodiment, the pad 1052 and pad frame 1072 may be accessed together through the left side aperture 1082 after removal of the cover member 1076. In another such illustrative embodiment, pad frame 1072 may allow such slidable access to the humidifier pad 1052 through a side of the pad frame. In another such illustrative embodiment, non-movable structures performing functions like those of pad frame (such as positioning a humidifier pad in an operating position) may be incorporated into the structure of the humidifier housing 1059, and configured to allow slidable access to the humidifier pad. In another such illustrative embodiment, the pad 1052 and water distributor 1074 may be accessed together through the left side aperture 1082 after removal of the cover member 1076. In yet another illustrative embodiment, the joined cover member 1076, pad frame 1072, and pad 1052 may be slidably removed via the left side aperture 1082, leaving the water distributor 1074 or similar structure in place in the humidifier 1040. These are only illustrative, and it is contemplated that any other suitable method of humidifier pad access through one or both of the side apertures 1080, 1082 may be included as well.

The illustrative humidifier 1040 also includes another cover member 1084 that may be releasably secured relative to the housing 1059 that substantially covers or closes the right side aperture 1084 when in an operating position. In some illustrative embodiments, cover member 1084 may be used to cover or close left side aperture 1082. In some illustrative embodiments, cover members 1084 and 1076 may be interchangeable with respect to left and right access apertures 1082 and 1080. Cover member 1084 may be releasably secured to the housing via, for example, an interference fit, clips, screws, pins or in any other suitable manner.

In some cases, humidifier pad 1052, pad frame 1072, water distributor 1074, and/or cover member 1076, or any subset thereof, may be structured with sufficient symmetry to allow sliding access through right side aperture 1080 as well as left side aperture 1082. In some cases, switching access sides may involve reconfiguration, such as moving cover member 1076 from the left side of pad frame 1072 (as illustrated) to the right side. The pad frame 1072 and cover member 1076 may include one or more attachment features configured to releasably secure the cover member to the pad frame. Attachment features may take any suitable form. In some illustrative embodiments, attachment features may take the form of one or more pins or rods 1086 and corresponding receiving apertures 1087, as illustrated in FIG. 10. Each pin or rod 1086 may include an enlarged head. The corresponding aperture 1087 for each pin or rod 1086 may include a hole that accommodates the enlarged head and a slot extending from the hole that accommodates the pin or rod but not the enlarged head. In some cases, pins or rods 1086 may be included on both right and left sides of pad frame 1072 to allow use of cover member 1076 on either side. In some embodiments, provision of pins/rods and receiving apertures may be reversed (e.g., pins on cover member, apertures on pad frame). When provided, it is contemplated that any suitable attachment features may be used, as desired.

The reconfigurable nature of some illustrative humidifiers of the present disclosure may afford HVAC technicians with flexibility when installing a humidifier. A humidifier structured to permit humidifier pad maintenance from both the left and right sides as described herein may be provided from the manufacturer configured for either left or right side access, or it may be provided configured for neither, with the configuration of the humidifier relegated the technician to perform. In an exemplary installation method, an HVAC technician may assess an installation location and choose a humidifier pad maintenance access side. The technician may then prepare the humidifier for installation, which may include verifying that the humidifier is already configured for pad access on the chosen side, configuring the humidifier for pad access on the chosen side, or reconfiguring the humidifier for pad access on the chosen side. Configuration or reconfiguration for pad access on the chosen side may involve securing a cover member such as 1084 of FIGS. 10 and 11 to the non-chosen side aperture (1080 or 1082), possibly after releasing the cover member from the side aperture on the chosen side. It may also involve attaching a cover member 1076 on the appropriate side of pad frame 1072, possibly after detaching it from the other side, and sliding the humidifier pad assembly including the frame and cover member into the chosen side aperture (1082 or 1080).

In an illustrative embodiment, a family of different humidifiers may be offered with cross-compatible parts, such as humidifier pads, pad frames, water distributors, cover members, and/or the like, or any subset thereof, thus potentially simplifying manufacturing, inventory, and sales logistics. In an illustrative example, the humidifiers of FIGS. 9 and 10/11 may be designed to accept common humidifier pads, pad frames, water distributors, and/or cover members. In one illustrative example, some parts may be cross-compatible between humidifiers, and some not. In one such illustrative example, humidifier pads and pad frames may be cross-compatible, but different cover members may be used with different humidifier models. Such different cover members may share some common features, such as attachment features cooperating with attachment features included on cross-compatible pad frames. While having such cross-compatible parts may be desirable in some cases, it is not required.

Figure 12:
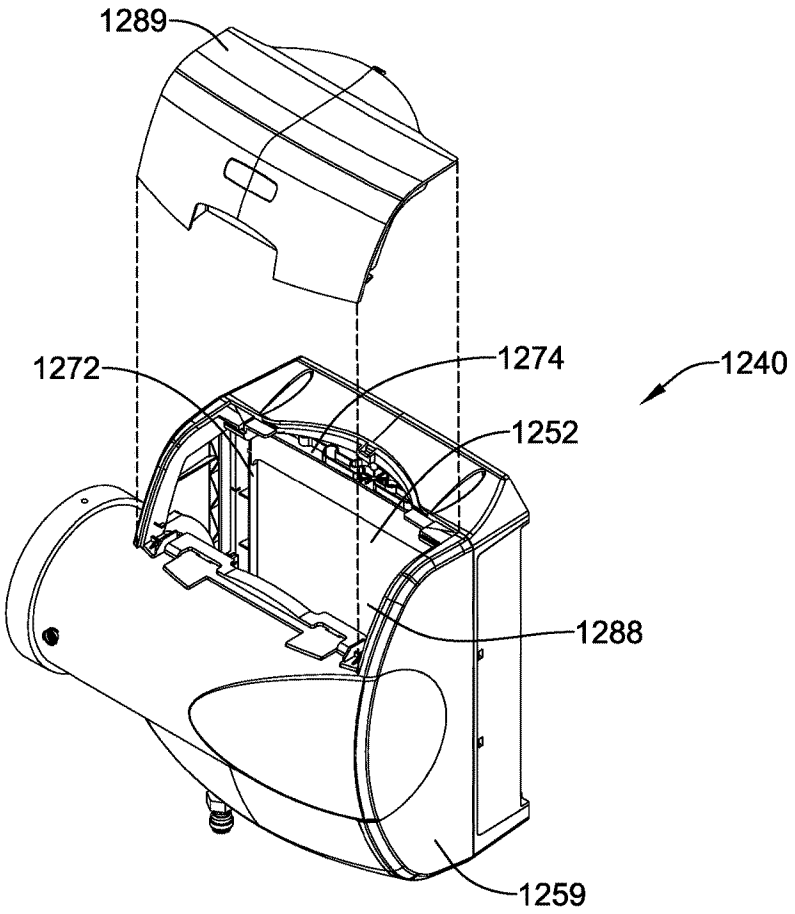
FIG. 12 is a schematic view of the illustrative bypass humidifier of FIG. 10 with the front cover lifted up.

Humidifiers configured for left and/or right side humidifier pad access may also have other modes of humidifier pad access as well. For example, FIG. 12 is a schematic view of the illustrative bypass humidifier of FIG. 10 with a front panel lifted up to provide access to the humidifier pad. In FIG. 12, the humidifier 1240 is similar to humidifier 1040, and may share many or all of the features with either or both, including a right side and/or a left side access aperture for providing humidifier pad access. Humidifier 1240 of FIG. 12 includes a housing 1259 whose front and/or top sides define a front and/or top access aperture or port 1288. (Herein front/top refer to a feature associated with the front and/or top sides of a humidifier, similar to that shown in FIG. 11) In the illustrative embodiment, front and/or top access aperture 1280 is sufficient in size to remove replaceable humidifier pad 1252 and install a new replaceable humidifier pad. In some illustrative embodiments, one or more other components, such as water distributor 1274 and/or pad frame 1272, may be accessible through front/top access aperture 1288 as well. In some illustrative embodiments, such an additional component or components may be removable while attached to humidifier pad 1262. In some illustrative embodiments, such components may be removable through front/top access aperture 1288 separately, or may remain in place while the humidifier pad is removed and/or replaced.

Figure 14:
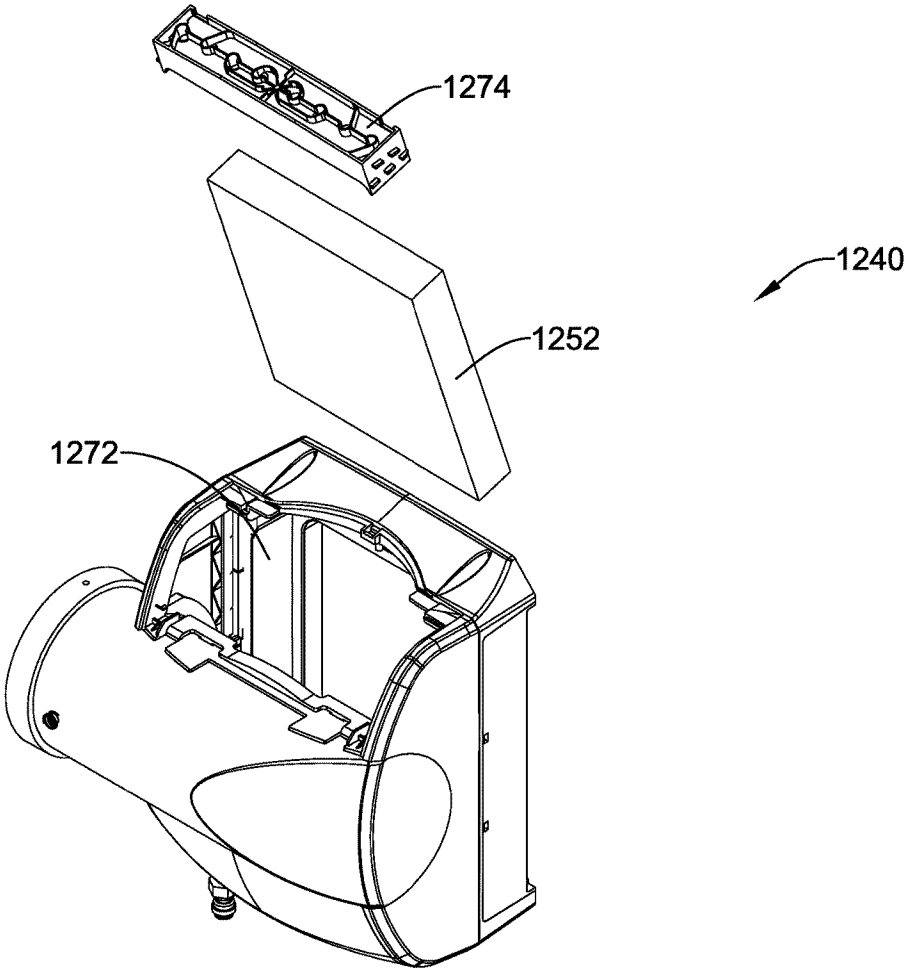
FIG. 14 is a schematic view of the illustrative bypass humidifier of FIG. 10 with the humidifier pad and water distributor removed during maintenance.

In an illustrative embodiment, humidifier pad replacement may be performed on humidifier 1240 through front and/or top access aperture 1288 after removal of front and/or top cover member 1289, which may be releasably secured to the humidifier housing 1259 via an interference fit, or any other suitable mechanism. After access to the interior of humidifier 1240 through the aperture 1288 is achieved, the humidifier pad 1252 may be removed and replaced in a procedure similar to that described herein for removing and replacing a humidifier pad from a humidifier pad assembly that has been removed from a humidifier, but in the procedure described here, the frame 1272 remains in an operational position in the humidifier 1240 throughout. The water distributor 1274 is grasped and pulled forward toward the front side of the housing 1259 to release the water distributor from the frame (see FIG. 13). As the water distributor 1274 is pulled forward, the mechanical engagement of the water distributor with the humidifier pad 1252 helps the two components pivot forward together relative to housing about a bottom edge of the humidifier pad disposed in the frame 1272. The frame 1272, housing 1259, water distributor 1274, and other components of humidifier 1240 are structured to permit this forward pivot and other motions in the humidifier pad removal and replacement sequence. Once the water distributor 1274 is disengaged from the frame 1272, the humidifier pad 1252 and the water distributor may be removed from the frame, either together or separately (see FIG. 14). A replacement humidifier pad may then be placed in the frame 1272, bottom edge first, and the water distributor 1274 engaged with the top side of the pad. The humidifier pad 1252 and water distributor 1274 are pivoted together backward in the frame 1272 toward the back of the housing 1249, and the water distributor is pushed into the frame until it attaches to the frame. The cover member 1289 may then be re-secured to the housing 1249.

Figure 15:
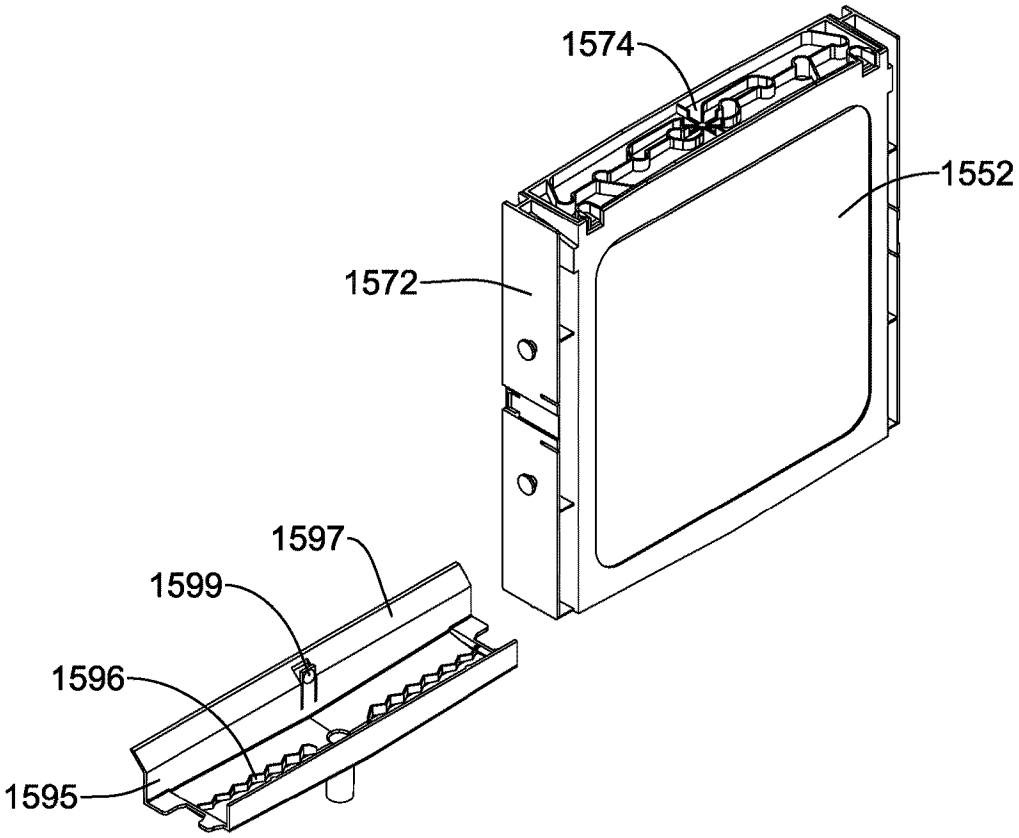
FIG. 15 is a schematic view of an illustrative humidifier pad assembly and an illustrative drain funnel.

It is noted that while pad maintenance for humidifier 1240 through front/top access aperture 1288 is described in such a way that the frame 1272 remains in an operational position in the humidifier during such maintenance, when access to the humidifier pad is achieved through a side access aperture (such as 1080 or 1082) in humidifiers such as humidifiers 840, 1040, and 1240, the frame and water distributor may remain engaged with the humidifier pad during the removal and installation of the humidifier pad assembly. These humidifiers may include any suitable structures to guide the humidifier pad assemblies during such sliding side access. One humidifier component that may be structured to guide a humidifier pad assembly to the rightward and/or leftward for sliding side access is a drain funnel. Any of the humidifiers described herein may include a drain funnel structured to collect water from substantially the entire bottom side of a humidifier pad frame and direct the water to the water drain of the humidifier. The bottom side of a humidifier pad frame may also be structured to collect water from the humidifier pad and direct the water to the drain funnel. The pad frame and corresponding drain funnel may be complementarily structured to allow the frame to move slidably relative to the drain funnel to the rightward and/or leftward to facilitate humidifier pad maintenance through one or more side apertures. FIG. 15 is a schematic view of an illustrative drain funnel 1595 and a humidifier pad assembly displaced to the side of the funnel. Drain funnel 1595 may be disposed immediately below a pad frame 1572 when the frame is in an operational position in a humidifier, and is structured to guide frame 1572 in sliding motion to either the left, the right, or both. Drain funnel 1595 may include a guide structure, such as the illustrated serpentine or zig-zag guide 1596, to support and guide the frame 1572 in siding motion. Illustrative drain funnel 1595 also includes a flared brim 1597 extending along a top edge of the drain funnel, disposed proximal the lower portion of the humidifier pad 1552 adjacent one of the pad's major surfaces when the pad is in an operational position. The flared brim 1597 is configured to capture water and direct the water to the water drain. Flared brim 1597 may be structured in such a way that it does not interfere with pivoting of a humidifier pad during pad maintenance such as that illustrated in part in FIG. 13 and described in the corresponding parts of this written description. Drain funnel 1595 may also include an alignment structure 1599 that may cooperate with a corresponding structure on pad frame 1572 (shown as 1073 in FIG. 11) to assist in positioning the frame properly when siding the frame into its operating position.

Figure 16:
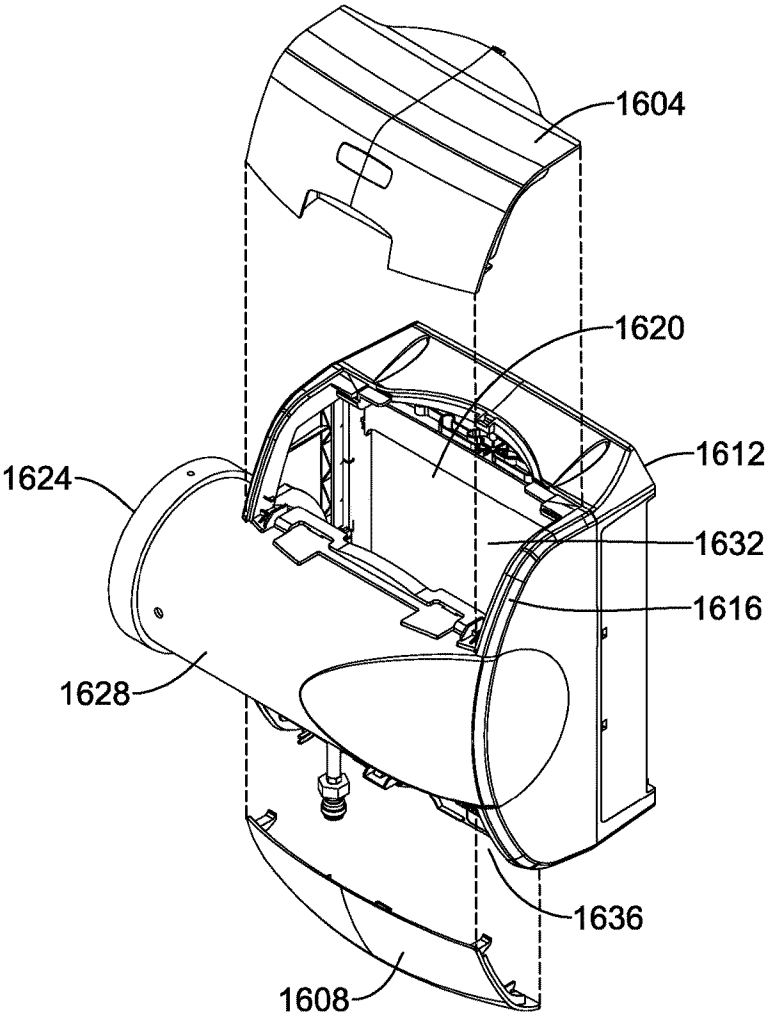
FIG. 16 is a schematic view of an illustrative bypass humidifier with a top-front cover and a bottom-front cover removed.

In some illustrative embodiments, the present disclosure provides bypass humidifiers that are field-reconfigurable to allow flexibility in positioning of a bypass duct. FIG. 16 is a schematic view of an illustrative bypass humidifier 1600 with top-front cover 1604 and bottom-front cover 1608 removed. Illustrative bypass humidifier 1600 is similar to other bypass humidifiers of the present disclosure, such as the bypass humidifiers illustrated in FIGS. 10-14 and described in the corresponding parts of the written description, and may include any or all other compatible humidifier features disclosed herein. As can be seen, the illustrative bypass humidifier 1600 is configured to be mounted to a surface of an HVAC duct (not shown), with back side 1612 of housing 1616 positioned adjacent to an opening in the surface of the HVAC duct (not shown). In the illustrative embodiment, the housing 1616 provides a first air flow path from the back side (not seen in this view) of humidifier pad 1620 to the opening in the HVAC duct (not shown). The housing 1616 provides a second air flow path from the front (visible) side of the humidifier pad 1620 to a bypass aperture 1624 of bypass duct member 1628, which defines at least part of the second air flow path.

Removal of the top-front and bottom-front covers 1604, 1608 exposes the top-front and bottom-front apertures 1632, 1636 of the housing 1616, providing access to the interior of the bypass humidifier 1600. In the illustrative embodiment, with the covers 1604, 1608 removed, the bypass duct member 1628 may be reconfigured between at least two positions. Such reconfiguration may be performed in the field during installation, at the time of manufacture, or at any other appropriate time. In each of the positions of the bypass duct member, the bypass aperture 1624 is located in a different location. In FIG. 16, for example, the bypass aperture 1624 is located toward the left side of bypass humidifier 1600. In another configuration, bypass duct member 1628 is positioned such that bypass aperture 1624 is located towards the right side of bypass humidifier 1600. In some embodiments, other configurations having other bypass aperture locations are contemplated. Also, while removable top-front and bottom-front covers 1604, 1608 are shown in the illustrative embodiment of FIG. 16, such covers are not required, and in some cases, not desired. However, regardless of whether top-front and bottom-front covers 1604, 1608 are provided, it is contemplated that the bypass duct member may be field-reconfigurable between at least a first position resulting in the bypass aperture being located at a first location, and a second position resulting in the bypass aperture being located at a second location.

Figure 17:
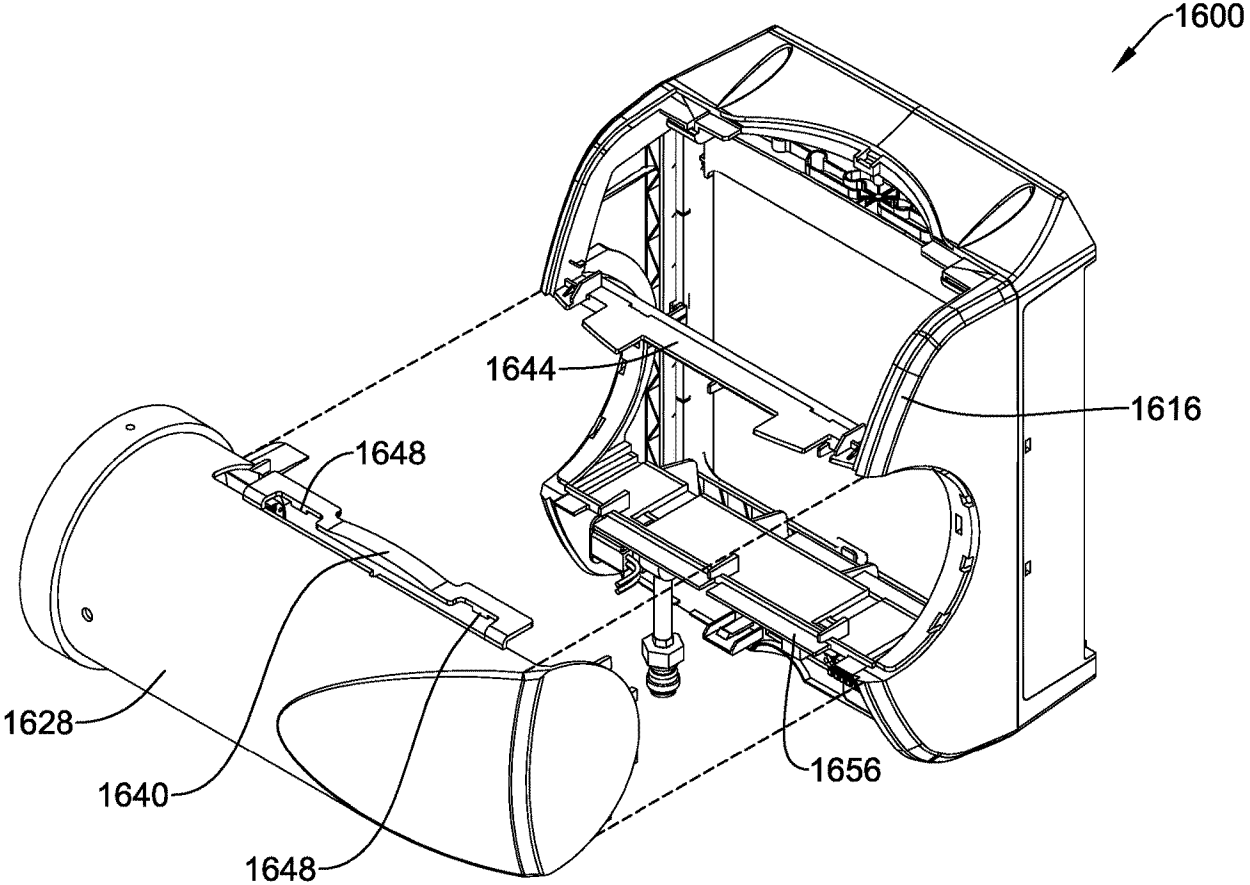
FIG. 17 is a schematic view of the illustrative bypass humidifier of FIG. 16 with the bypass duct member detached from the humidifier housing.
Figure 18:
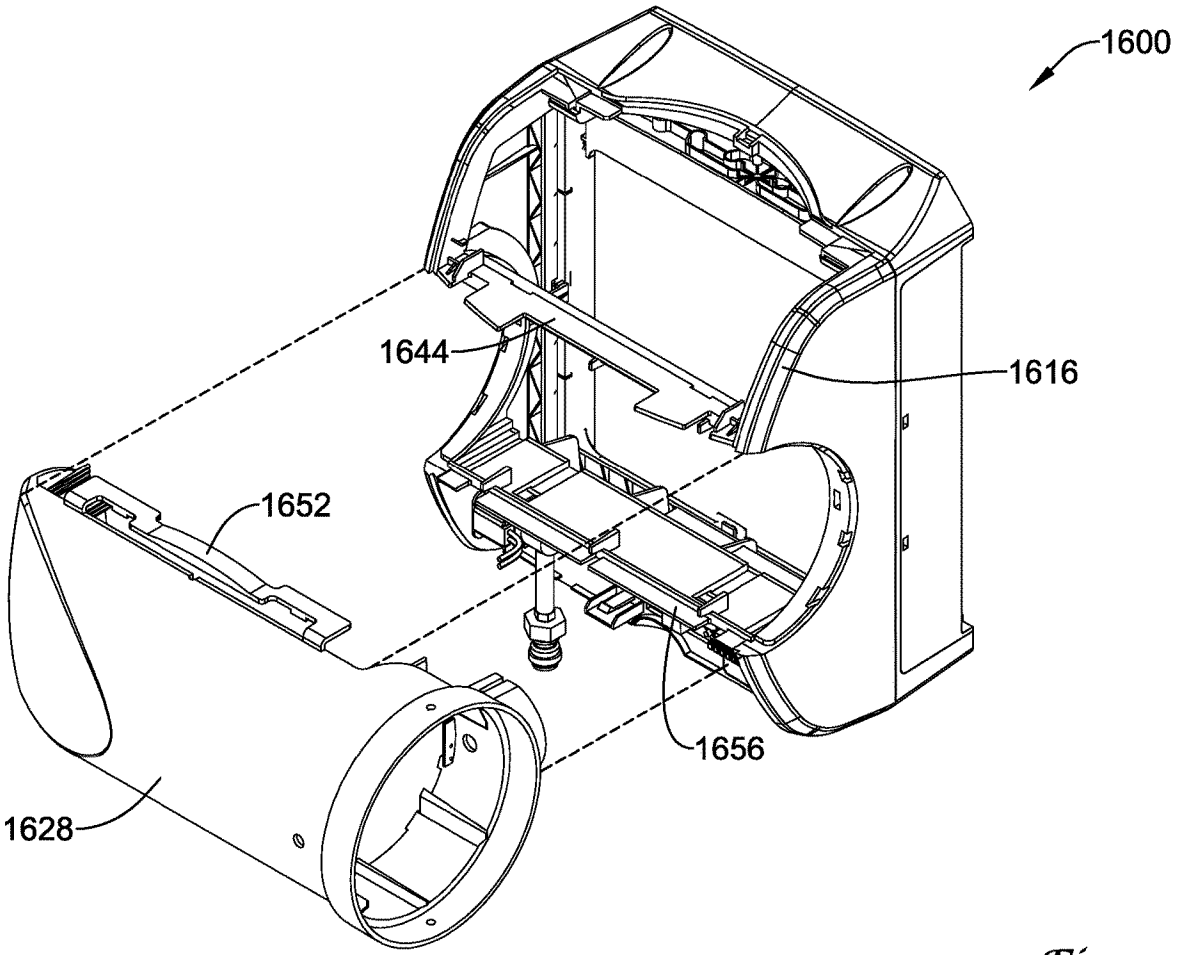
FIG. 18 is a schematic view of the illustrative bypass humidifier 1600 of FIGS. 16 and 17 with detached bypass duct member 1628 rotated to a different position compared to that shown in FIG. 17, whereupon it may be reattached to the humidifier housing.

FIGS. 17 and 18 illustrate intermediate steps during reconfiguration of the position of bypass duct member 1628 of FIG. 16. FIG. 17 is a schematic view of the illustrative bypass humidifier 1600 of FIG. 16 with the bypass duct member 1628 detached from the humidifier housing 1616. It is contemplated that any appropriate structure and/or method may be used to attach bypass duct member 1628 to the humidifier housing 1616, and any suitable method may be used to detach the member from the housing. In the illustrative embodiment, bypass duct member 1628 includes a first handle 1640 structured to cooperate with a first attachment guide 1644 of the housing 1616 to removably maintain the bypass duct member 1628 in a first operating position, with the bypass aperture 1624 facing toward the left. The first handle 1640 and/or first attachment guide 1644 may be structured with any suitable retention mechanism(s). For example, first handle 1640 may include one or more detachable retaining elements 1648, which may be clips that engage with corresponding portions of first attachment guide 1644. A retention mechanism may be structured such that it may be released by a user. For example, in the illustrative embodiment illustrated in FIGS. 16-18, retaining elements 1648 may be released by the action of a user grasping and flexing (or otherwise manipulating) first handle 1640.

FIG. 18 is a schematic view of the illustrative bypass humidifier 1600 of FIGS. 16 and 17 with detached bypass duct member 1628 rotated to a different orientation compared to that shown in FIG. 17. As seen in FIG. 18, the illustrative bypass duct member 1628 may include a second handle 1652. First handle 1640 and second handle 1652 may be structured sufficiently similarly that they may operate interchangeably, at least in some aspects. For example, in the orientation shown in FIG. 18, bypass duct member 1628 may be moved toward the humidifier housing in a sliding motion such that second handle 1652 may cooperatively engage with first attachment guide 1644 to removably maintain the bypass duct member in a second operating position, with bypass aperture 1624 facing toward the right, similar to the way, in the orientation shown in FIG. 17, first handle 1640 may cooperatively engage with first attachment guide 1644 to removably maintain the bypass duct member in the first operating position.

The humidifier housing 1616 may also include a second attachment guide 1656 structured to cooperate with both the second handle 1652 and the first handle 1640, depending on the orientation of the bypass duct member 1628. For example, second handle 1652 and second attachment guide 1656 may cooperate to removably maintain bypass duct member 1628 in the first operating position, while first handle 1640 and second attachment guide 1656 may cooperate to removably maintain bypass duct member 1628 in the second operating position.

Field-reconfigurable humidifiers such as bypass humidifier 1600 may afford HVAC technicians another degree of flexibility when installing a humidifier. Such a technician may determine an installation location for the bypass humidifier 1600 and decide upon a humidifier configuration. The technician may then determine a desired bypass aperture location, for example, facing toward the left or right (or top, bottom, etc.) relative to the humidifier housing. If the humidifier is not already configured with the bypass duct member in the desired position, the technician may reconfigure the humidifier as desired. In accordance with the descriptions corresponding to FIGS. 16-18, such a method of humidifier configuration may include removing the bypass duct member from a current position, and then attaching the bypass duct member into another position. In some cases, removing the bypass duct member may involve manipulating at least one handle of the bypass duct member, but this is not required. Other steps may included, for example, removing covers such as top-front and bottom-front covers 1604, 1608 of a humidifier 1600, and replacing the covers after attaching the bypass duct member in the second position. In some cases, a bypass humidifier may be supplied to an installer in a partially assembled state, with final assembly to be completed in the field. In some cases, the bypass duct member may not be assembled with the humidifier housing, and it is left to the installer to install the bypass duct member into the proper position depending on the particular installation. In other cases, a bypass humidifier is provided fully assembled, but structured such as described herein to permit at least partial disassembly and reassembly into a desired configuration.

The illustrative bypass humidifier of FIG. 10 includes a bypass aperture 1091, defined by housing 1059, with an integral bypass damper 1094 disposed at or proximal to the bypass aperture. Referring both to FIGS. 1 and 10, a bypass humidifier 140, 1040 is typically attached to and in fluid communication with a supply duct 130 through an air intake 1058, and also in fluid communication with a bypass duct 190 through a bypass aperture 1091. The bypass duct is typically in fluid communication with a return air duct 110 of an HVAC system and forms, along with the bypass humidifier 140, 1040, a bypass air path from the supply duct 130, through the humidifier pad, and to the return duct 110. In some illustrative embodiments, the relative positions of the bypass humidifier and bypass duct may be reversed, so that the bypass air path passes first through the bypass duct and then the humidifier. In such a case, the air flow aperture 1058 may be considered an air outlet rather than an air intake.

The illustrative bypass humidifier 1040 of FIG. 10 includes an integral bypass damper 1094, while the illustrative bypass humidifier system of HVAC system 100 of FIG. 1 includes a generalized bypass damper 194 disposed in the bypass air path. A damper may be used to either substantially block or allow the flow of air through the bypass air path. When there is a need to add humidity via a bypass humidifier, such as during the winter months in colder climates, the bypass damper if present may be opened so that air may flow through the moistened humidifier pad of the bypass humidifier and back to the return duct. In the absence of a need to add humidity, such as in the summer months, the bypass damper if present may be closed to prevent air from traveling to the return duct. Having air pass from the supply duct to the return duct, when adding humidity is not desired, can reduce the efficiency of the HVAC system because conditioned air from the supply duct is diverted back to the return duct instead of being delivered to the conditioned air space (e.g., living or working space).

While bypass damper 1094 of FIG. 10 is shown with a single circular blade, any suitable form of damper may be used. Some types of dampers that may be used include, but are not limited to, airfoil dampers, flat blade dampers, multiple blade dampers, V groove dampers, single blade dampers with approximately 90 degrees of motion, single blade dampers with 360 degrees of motion, multiple vane rotating or sliding dampers, gate valve dampers, inflatable dampers, and/or any other suitable type of damper as desired. It is contemplated that such bypass dampers may be used in conjunction with the illustrative bypass humidifier of FIGS. 16-18, if desired.

In a conventional bypass humidification system, a manually operated bypass damper may be provided to substantially block the flow of air in the bypass air path on a seasonal basis. However, several shortcomings are associated with such manual damper operation. Particularly in a residential setting, a homeowner may not know about the need to open the damper during the humidification season, and to close the damper during the non-humidification season. Additionally, the homeowner may not set the damper properly even if aware of the need to manipulate it. Inefficient or ineffective humidification and/or poor or less efficient HVAC performance may result. Furthermore, even when the damper is correctly set, during humidification season the HVAC system (with the damper open) may operate for significant periods of time without need to add humidity, which may result in decreased HVAC system efficiency during the humidification season.

In some illustrative embodiments, bypass humidification systems may be provided with powered bypass dampers that may be actuated without human manipulation. Such a damper may be integrated with a bypass humidifier, such as with damper 1094 of humidifier 1040 of FIG. 10, or it may be provided as a bypass humidification system component distinct from a humidifier, as suggested schematically by bypass damper 194 of FIG. 1. A damper actuator may take any suitable form. For example, the damper actuator may include an electrically operated motor that moves the damper in both directions. In another example, the damper actuator may include an electrically operated motor that moves the damper in one direction (e.g. closed), and another motor or a spring to provide return travel (e.g. opened). A damper may be actuated by a motor that may continuously oscillate a damper between opened and closed states, with provision for stopping the motor at the appropriate end points of travel. A single acting solenoid with spring return may be used, or a double acting solenoid may be employed. A wax motor linear actuator with a spring return may be used. These are only examples, and it is contemplated that any suitable actuation mechanism may be used.

Such a powered bypass damper actuator may be instructed to open or close by any suitable controller. In one illustrative embodiment, a bypass damper is configured to open when a call for humidity is received from an HVAC controller, and to close upon termination of the call for humidity. In one illustrative embodiment, a bypass damper is configured to open when both a call for humidity has been made, and the air handler is activated to circulate air in the HVAC system. In one illustrative embodiment, a controller is configured to command a bypass damper to close following a time interval after the end of a call for humidity. This delay in closing the damper may allow a humidifier component, such as a humidifier pad, to dry when subjected to continued bypass airflow prior to bypass damper closure. In an illustrative embodiment, a controller may instruct a bypass damper to close after assessing the amount of moisture within a bypass humidifier, either via direct sensing via one or more sensors, or by inference. Such inference may be made on the basis of measurements of one or more sensors not directly sensing humidifier moisture, or it may be made by deduction based on expected performance (for example, by the duration of airflow in an HVAC system known to be sufficient to dry a humidifier pad) or by any other suitable method of inference.

An illustrative bypass humidifier may include a local controller provided within or proximal to the humidifier itself that issues open and close commands to a bypass damper, including any delays, in response to the presence or absence of calls for humidity from another HVAC controller. In one illustrative embodiment, a simple delay timer circuit may be employed in such a local controller. In another illustrative embodiment, a remote HVAC controller may send a plurality of commands to the bypass humidifier, including commands to a water source control valve to start and stop water flow, and commands to open and close the bypass damper, including any delays if used.

Some of these features are represented in FIG. 4. Trace 450 represents an illustrative bypass damper operation, with high portions representing an open damper and low portions representing a closed damper. In the illustrative diagram, the damper is commanded to open at 452, in concert with the start of a call for humidity at 412. Note that a call for heat is present at this time, and the air handler is active and in operation. In one illustrative embodiment, if a call for humidity commenced in the absence of a call for heat, humidifier operation (e.g., water flow and damper opening) may be delayed until heated airflow begins. In some illustrative embodiments, a call for humidifier operation is present with the simultaneous combination of a call for humidity and the air handler is in operation. In some illustrative embodiments, a simultaneous call for heat is further required for a call for humidifier operation to exist. At 454, the damper is instructed to close, in coordination with the termination of air handler operation at 442. In one illustrative embodiment, the damper may remain open in such a scenario as long as a call for humidity persists. At 456, the damper may reopen along with the resumption of air handler operation at 444. After a delay following the end of the call for humidity at 414, the damper may close at 458.

In some illustrative HVAC systems having a bypass humidifier, powered bypass dampers are not provided, but an HVAC controller, such as a thermostat, humidistat, or any other suitable controller, is provided for use in conjunction with a manually-operated bypass damper. Such a controller may be used, for example, with a new HVAC installation or when retrofitted with an existing HVAC system. With the bypass damper configured for manual operation, the HVAC controller may be configured to indicate, communicate, and/or instruct the user, through a user interface or the like, when to adjust or manipulate (i.e., open or close) the bypass damper for more efficient operation. Such notification may be achieved through any suitable mechanism, including a visual display, an audible annunciation, an electrical, electronic, optical, or any other signal transmitted to a system that engages the user's attention, such as an electronic messaging system, and the like. In one illustrative embodiment, an HVAC controller may be configured to accept input from a user indicating and/or acknowledging the disposition of a bypass damper. In one illustrative embodiment, an HVAC controller is configured to maintain a bypass damper notification until a user clears the notification with such an input. In one illustrative embodiment, a controller is configured to permit a user to request delayed compliance with an instruction to open or close a damper for a delay interval. After such an interval, the controller may repeat the instruction, much as an alarm clock may re-sound an alarm after a "snooze" period.

An HVAC controller may be configured in any suitable way to determine when to issue an instruction to open and/or close a bypass damper (i.e., allow or block bypass airflow), whether the instruction is issued to a powered bypass damper, or whether it is presented to a user for manual actuation. A controller may be configured to issue damper adjustment instructions seasonally (e.g., open in the fall and close in the spring) or more frequently. Damper adjustment instructions may be based upon a fixed calendar, possibly based on the latitude and/or longitude of the system, or a controller may be configured to employ any suitable method for determining a need to adjust a damper.

In an illustrative embodiment, an HVAC or other controller may issue an instruction to open a bypass damper coincident with a first call for humidity following an extended time period without any calls for humidity. In another illustrative embodiment, an or other HVAC controller does not issue an instruction to open a bypass damper coincident with a first call for humidity following an extended time period without any calls for humidity, but instead waits for a repeated call for humidity before issuing such an instruction. In an illustrative embodiment, an HVAC or other controller may issue an instruction to close a bypass damper after an extended time interval without any calls for humidity. In some embodiments, HVAC or other controllers may use any suitable data source in determining when to issue instructions for opening and/or closing bypass dampers, including HVAC system historical performance, climatological history or other weather data such as humidity readings, and the like.

In some illustrative embodiments, a controller may incorporate input from one or more sensors for detecting at least one property associated with the operation of the HVAC system to determine a current bypass damper position. Such a sensor may directly sense a bypass damper position, or it may provide data that allow the controller to infer a damper position. For example, data from a humidity sensor may lead a controller to perceive deficient humidification performance despite delivery of water to a bypass humidifier, which may indicate a closed bypass damper. In another example, pressure drop data within HVAC ductwork may suggest the position of a bypass damper. In an illustrative embodiment, an HVAC controller may employ memory hardware to retain system status information, such as the current position of a bypass damper.

The disclosure should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

What is claimed is:

1. A humidifier for adding humidity to an air stream in response to a call for humidity, the humidifier comprising:
- an air intake configured to fluidically interface with an HVAC duct;
- a humidifier pad in fluid communication with the air intake;
- a water valve for selectively delivering water from a water source to the humidifier pad; and
- a controller for controlling the water valve, wherein the controller is configured to cause the water valve to deliver water to the humidifier pad in a water delivery pattern having a period and a duty cycle, wherein the period/duty cycle combination is configured to achieve a humidity transfer rate from the humidifier pad to the air stream that is substantially the same as a humidity transfer rate resulting from an always-on delivery of water to the humidifier pad during the call for humidity.

2. The humidifier of claim 1, wherein the period is greater than 120 seconds and the duty cycle is greater than 50%.

3. The humidifier of claim 1, wherein the period is greater than 180 seconds and the duty cycle is greater than 30%.

4. The humidifier of claim 1, wherein the period is greater than about 240 seconds and the duty cycle is greater than 40%.

5. The humidifier of claim 1, wherein the period is greater than 60 seconds and the duty cycle is greater than 30%.

6. The humidifier of claim 1, wherein the period is greater than 180 seconds and the duty cycle is greater than 20%.

7. The humidifier of claim 1, wherein the period and/or duty cycle are field programmable by a user.

8. A humidifier for adding humidity to an air stream of an HVAC system during a call for humidity, wherein the call for humidity has a call duration, the humidifier comprising:
- a humidifier housing;
- an air intake configured to fluidically interface with an HVAC duct of the HVAC system;
- a humidifier pad within the humidifier housing, wherein humidifier pad is in fluid communication with the air intake;
- a water valve for controlling delivery of water from a water source to the humidifier pad; and
- a humidifier controller within the humidifier housing and configured to receive the call for humidity signal from an HVAC controller that is external to the humidifier housing, wherein the humidifier controller is configured to send control signals to activate/deactivate the water valve such that water is delivered to the humidifier pad during the call for humidity but for less time than the call duration of the call for humidity, and
- wherein the humidifier controller is configured to cause the water valve to deliver water to the humidifier pad in a water delivery pattern having a period and a duty cycle, wherein the period/duty cycle combination is set to achieve a humidity transfer rate from the humidifier pad to the air stream that is substantially the same as a humidity transfer rate resulting from an always-on delivery of water to the humidifier pad during the call for humidity.

9. The humidifier of claim 8, wherein the period and the duty cycle of the water delivery pattern are fixed during the call for humidity.

10. The humidifier of claim 9, wherein the period is greater than 120 seconds and the duty cycle is greater than 50%.

11. The humidifier of claim 9, wherein the period is greater than 180 seconds and the duty cycle is greater than 30%.

12. The humidifier of claim 9, wherein the period is greater than about 240 seconds and the duty cycle is greater than 40%.

13. The humidifier of claim 9, wherein the period is greater than 60 seconds and the duty cycle is greater than 30%.

14. The humidifier of claim 9, wherein the period is greater than 180 seconds and the duty cycle is greater than 20%.

15. The humidifier of claim 8, wherein the humidifier controller is configured to cause the water valve to deliver water to the humidifier pad for greater than 30% of the call duration of the call for humidity.

16. The humidifier of claim 8, wherein the humidifier controller is configured to allow a user to field program one or more parameters that effect an amount of time that water is delivered to the humidifier pad during the call for humidity.

17. A humidifier for adding humidity to an air stream, the humidifier comprising:

an air intake configured to fluidically interface with an HVAC duct;

a humidifier pad in fluid communication with the air intake;

a water valve for selectively delivering water from a water source to the humidifier pad; and a controller for controlling the water valve, wherein the controller is configured to:

cause the water valve to deliver water to the humidifier pad in a water delivery pattern having at least one "on" cycle and at least one "off" cycle during a call for humidity such that:

the at least one "on" cycle and the at least one "off" cycle combination is set to achieve a humidity transfer rate from the humidifier pad to the air stream that is substantially the same as a humidity transfer rate resulting from an always-on delivery of water to the humidifier pad during the call for humidity, and less than about 70% of the water delivered to the humidifier pad from the water valve drains from the humidifier pad during the call for humidity; and allow a user to program in the field one or more water delivery pattern parameters that effect the water delivery pattern.

18. The humidifier of claim 17, wherein the one or more water delivery pattern parameters include a period and/or a duty cycle, and the controller is configured to allow a user to program in the field one or more of the period and duty cycle.

19. The humidifier of claim 18, wherein the period is greater than 180 seconds and the duty cycle is greater than 30%.

20. The humidifier of claim 17, wherein the water delivery pattern is fixed during the call for humidity.

* * * * *